US005272052A

United States Patent [19]

Maskasky

[11] Patent Number: 5,272,052

[45] Date of Patent: Dec. 21, 1993

[54] PROCESS FOR THE PREPARATION OF A GRAIN STABILIZED HIGH CHLORIDE TABULAR GRAIN PHOTOGRAPHIC EMULSION (IV)

[75] Inventor: Joe E. Maskasky, Rochester, N.Y.

[73] Assignee: Eastman Kodak Company, Rochester, N.Y.

[21] Appl. No.: 935,933

[22] Filed: Aug. 27, 1992

[51] Int. Cl.[5] ..... G03C 1/005; G03C 1/015; G03C 1/035

[52] U.S. Cl. ..... 430/569; 430/567; 430/614; 430/615; 430/588; 430/592

[58] Field of Search ..... 430/567, 569, 614, 615, 430/588, 592

[56] References Cited

U.S. PATENT DOCUMENTS

| | | | |
|---|---|---|---|
| 2,131,038 | 9/1938 | Brooker | 430/614 |
| 4,063,951 | 12/1977 | Bogg | 430/569 |
| 4,386,156 | 5/1983 | Mignot | 430/569 |
| 4,399,215 | 8/1983 | Wey | 430/569 |
| 4,400,463 | 8/1983 | Maskasky | 430/434 |
| 4,414,306 | 11/1983 | Wey et al. | 430/569 |
| 4,435,501 | 3/1984 | Maskasky | 430/569 |
| 4,657,846 | 4/1987 | Kokubo et al. | 430/588 |
| 4,713,323 | 12/1987 | Maskasky | 430/569 |
| 4,783,398 | 11/1988 | Takada et al. | 430/567 |
| 4,786,588 | 11/1988 | Ogawa et al. | 430/569 |
| 4,791,053 | 12/1988 | Ogawa et al. | 430/569 |
| 4,804,621 | 2/1989 | Tufano et al. | 430/567 |
| 4,820,624 | 4/1989 | Hasebe et al. | 430/567 |
| 4,865,962 | 9/1989 | Hasebe et al. | 430/567 |
| 4,940,657 | 7/1990 | Tanaka et al. | 430/578 |
| 4,942,120 | 7/1990 | King et al. | 430/567 |
| 4,952,491 | 8/1990 | Nishikawa et al. | 430/570 |
| 4,983,508 | 1/1991 | Ishiguro et al. | 430/569 |
| 5,035,992 | 7/1991 | Houle et al. | 430/569 |
| 5,176,991 | 1/1993 | Jones et al. | 430/569 |
| 5,176,992 | 1/1993 | Maskasky et al. | 430/569 |
| 5,176,992 | 1/1993 | Maskasky et al. | 430/567 |
| 5,178,997 | 1/1993 | Maskasky | 430/569 |
| 5,178,998 | 1/1993 | Maskasky et al. | 430/569 |
| 5,183,732 | 2/1993 | Maskasky | 430/569 |
| 5,185,239 | 2/1993 | Maskasky | 430/569 |
| 5,217,858 | 6/1993 | Maskasky | 430/567 |
| 5,221,602 | 6/1993 | Maskasky | 430/567 |

FOREIGN PATENT DOCUMENTS

| | | |
|---|---|---|
| 3-116133 | 5/1991 | Japan . |
| 3-252649 | 11/1991 | Japan . |
| 288143 | 12/1991 | Japan . |

OTHER PUBLICATIONS

Research Disclosure vol. 308, Dec. 1989, Item 308119.

Symposium: Torino 1963, Photographic Science, Edited by C. Semerano and U. Mazzucato, Focal Press 52–55.

Sugimoto and Miyake, "Mechanism of Halide Conversion Process of Colloidal AgCl Microcrystals by $Br^-$ Ions", Parts I and II, *Journal of Colloid and Interface Science*, vol. 140, No. Dec. 1990, pp. 335–361.

*Primary Examiner*—Charles L. Bowers, Jr.
*Assistant Examiner*—Mark F. Huff
*Attorney, Agent, or Firm*—Carl O. Thomas

[57] ABSTRACT

A process is disclosed of preparing an emulsion for photographic use comprised of silver halide grains and a gelatino-peptizer dispersing medium in which morphologically unstable tabular grains having {111} major faces account for greater than 50 percent of total grain projected area and contain at least 50 mole percent chloride, based on silver. The emulsion additionally contains at least one 2-hydroaminoazine adsorbed to and morphologically stabilizing the tabular grains. A silver salt is epitaxially deposited epitaxially at one or more corners of the tabular grains. Protonation releases 2-hydroaminoazine from the tabular grain surfaces into the dispersing medium. Released 2-hydroaminoazine is replaced on the tabular grain surfaces by adsorption of a photographically useful compound selected from among those that contain at least one stabilizing chalcogen atom or at least one 5-iodobenzoxazolium nucleus or a photographically useful cationic benzimidazolium dye, thereby concurrently morphologically stabilizing the tabular grains and enhancing their photographic utility, and the released 2-hydroaminoazine is removed from the dispersing medium.

20 Claims, 9 Drawing Sheets

2.0 μm 2.0 μm 2.0 μm 2.0 μm 2.0 μm 2.0 μm 2.0 μm 0.5 μm 0.5 μm

PROCESS FOR THE PREPARATION OF A GRAIN STABILIZED HIGH CHLORIDE TABULAR GRAIN PHOTOGRAPHIC EMULSION (IV)

FIELD OF THE INVENTION

The invention is directed to a process of preparing for photographic use high chloride tabular grain emulsions.

Definition of Terms

The term "high chloride" refers to silver halide grains or emulsions in which chloride accounts for at least 50 mole percent of total halide, based on silver.

The term "2-hydroaminoazine" refers to azines having a primary or secondary amino substituent that is bonded to the azine ring at a location next adjacent a ring nitrogen atom.

The term "hydroamino" is employed to designate amino groups containing at least one hydrogen substituent of the nitrogen atom—i.e., a primary or secondary amino substituent.

The term "azine" is employed to embrace six membered aromatic heterocylic rings containing carbon atoms and at least one nitrogen atom.

The term "morphological stabilization" refers to stabilizing the geometrical shape of a host tabular grain and/or the location on the host tabular grain of epitaxial deposits.

The term "stabilizer" is employed in its art recognized usage to designate photographic addenda that retard variances in emulsion sensitometric properties.

The term tabular "grain" is employed to designate grains having two parallel major faces lying in {111} crystallographic planes.

The terms "monolayer coverage" and "monomolecular layer" are employed in their art recognized usage to designate the calculated concentration of an adsorbed species that, if uniformly distributed on emulsion grain surfaces, would provide a layer of one molecule thickness.

The term "photographically useful compound" refers to compounds (i.e., addenda) that function during the storage, exposure and/or processing of photographic elements to enhance their image forming properties.

BACKGROUND OF THE INVENTION

Radiation sensitive silver halide emulsions containing one or a combination of chloride, bromide and iodide ions have been long recognized to be useful in photography. Each halide ion selection is known to impart particular photographic advantages. By a wide margin the most commonly employed photographic emulsions are silver bromide and bromoiodide emulsions. Although known and used for many years for selected photographic applications, the more rapid developability and the ecological advantages of high chloride emulsions have provided an impetus for employing these emulsions over a broader range of photographic applications.

During the 1980's a marked advance took place in silver halide photography based on the discovery that a wide range of photographic advantages, such as improved speed-granularity relationships, increased covering power both on an absolute basis and as a function of binder hardening, more rapid developability, increased thermal stability, increased separation of native and spectral sensitization imparted imaging speeds, and improved image sharpness in both mono- and multi-emulsion layer formats, can be realized by increasing the proportions of selected tabular grain populations in photographic emulsions.

In almost every instance tabular grain emulsions have been formed by introducing two or more parallel twin planes into octahedral grains during their preparation. Regular octahedral grains are bounded by {111} crystal faces. The predominant feature of tabular grains formed by twinning are opposed parallel {111} major crystal faces. The major crystal faces have a three fold symmetry, typically appearing triangular or hexagonal.

(a) Morphologically Stable Tabular Grains

The formation of tabular grain emulsions containing parallel twin planes is most easily accomplished in the preparation of silver bromide emulsions. The art has developed the capability of including photographically useful levels of iodide. The inclusion of high levels of chloride as opposed to bromide, alone or in combination with iodide, has been difficult. Silver chloride differs from silver bromide in exhibiting a much stronger propensity toward the formation of grains with faces lying in {100} crystallographic planes. To produce successfully a high chloride tabular grain emulsion by twinning, conditions must be found that favor both the formation of twin planes and {111} crystal faces. Further, after the emulsion has been formed, tabular grain morphological stabilization is required to avoid reversion of the grains to their favored more stable form exhibiting {100} crystal faces. When high chloride tabular grains having {111} major faces undergo morphological reversion to forms presenting {100} grain faces the tabular character of the grains is either significantly degraded or entirely destroyed and this results in the loss of the photographic advantages known to be provided by tabular grains.

Maskasky U.S. Pat. No. 4,400,463 (hereinafter designated Maskasky I) was the first to prepare in the presence of a 2-hydroaminoazine a high chloride emulsion containing tabular grains with parallel twin planes and {111} major crystal faces. The strategy was to use a particularly selected synthetic polymeric peptizer in combination with an adsorbed aminoazaindene, preferably adenine, acting as a grain growth modifier.

Maskasky U.S. Pat. No. 4,713,323 (hereinafter designated Maskasky II), significantly advanced the state of the art by preparing high chloride emulsions containing tabular grains with parallel twin planes and {111} major crystal faces using an aminoazaindene grain growth modifier and a gelatino-peptizer containing up to 30 micromoles per gram of methionine. Since the methionine content of a gelatino-peptizer, if objectionably high, can be readily reduced by treatment with a strong oxidizing agent (or alkylating agent, King et al U.S. Pat. No. 4,942,120), Maskasky II placed within reach of the art high chloride tabular grain emulsions with significant bromide and iodide ion inclusions prepared starting with conventional and universally available peptizers.

Maskasky I and II have stimulated further investigations of grain growth modifiers capable of preparing high chloride emulsions of similar tabular grain content. As grain growth modifiers, Tufano et al U.S. Pat. No. 4,804,621 employed 4,6-di(hydroamino)pyrimidines lacking a 5-position amino substituent (a 2-hydroaminoazine species); Japanese patent application 03/116,133, published May 17, 1991, employed adenine (a 2-hydroaminoazine species) in the pH range of from 4.5 to 8.5; Takada et al U.S. Pat. No. 4,783,398 employed heterocycles containing a divalent sulfur ring atom; Nishikawa et al U.S. Pat. No. 4,952,491 employed spectral sensitizing dyes and divalent sulfur atom containing heterocycles and acyclic compounds; and Ishiguro et al U.S. Pat. No. 4,983,508 employed organic bis-quaternary amine salts.

In the foregoing patents there is little or no mention of stabilizing the tabular grain shape in the high chloride emulsions, since the continued presence of conditions favorable for stabilizing the {111} major faces of the tabular grains, usually the presence of a 2-hydroaminoazine, is assumed. Houle et al U.S. Pat. No. 5,035,992 specifically addresses the problem of stabilizing high chloride tabular grain emulsions prepared in the presence of a 2-hydroaminoazine (specifically 4,6-di(hydroamino)-pyrimidines lacking a 5-position amino substituent). Houle et al accomplished stabilization during tabular grain precipitation by continuously increasing the ratio of bromide to chloride being precipitated until the tabular grains were provided with stabilizing silver bromide shells. The Houle et al process has the disadvantage that the pyrimidine is left on the grain surfaces. Additionally, the grains remain morphologically unstable when their pH is lowered to remove the pyrimidine.

The emulsion teachings noted above either explicitly or implicitly suggest utilization of the emulsions with conventional grain adsorbed and unadsorbed addenda. A relatively recent summary of conventional photographic emulsion addenda is contained in Research Disclosure Vol. 308, December 1989, Item 308119. Research Disclosure is published by Kenneth Mason Publications, Ltd., Emsworth, Hampshire P010 7DD, England. While a wide variety of emulsion addenda can be adsorbed to grain surfaces, spectral sensitizing dyes and desensitizers (Res.Dis. Section IV) and antifoggants and stabilizers (Res.Dis. Section VI) are examples of photographically useful addenda that are almost always adsorbed to grain surfaces. Brooker U.S. Pat. No. 2,131,038 discloses benzoxazolium salts to be useful antifogging agents. Tanaka et al U.S. Pat. No. 4,940,657 discloses spectral sensitizing dyes containing at least one 5-iodobenzoxazolium nucleus.

Symposium: Torino 1963, Photographic Science, Edited by C. Semerano and U. Mazzucato, Focal Press 52–55, discloses ripening silver chloride emulsions in the presence of adenine or xanthine.

(b) Epitaxial Deposition

Maskasky U.S. Pat. No. 4,435,501 (hereinafter referred to as Maskasky III) discloses the selective site epitaxial deposition onto high aspect ratio tabular grains through the use of a site director. Example site directors include various cyanine spectral sensitizing dyes and adenine. In Example 24B silver bromide was deposited epitaxially onto the edges of high chloride tabular grains. Emulsion preparation was conducted at a temperature of 55° C. while using a benzoxazolium spectral sensitizing dye as a site director for epitaxial deposition lacking a 5-iodo substituent and hence lacking the capability of acting as a morpholigical stabilizer.

Ogawa et al U.S. Pat. Nos. 4,786,588 and 4,791,053 disclose transhalogenation of high chloride nontabular grains by the addition of bromide ions. Transhalogenation combined with the use of a sulfur sensitizer or at least one spectral sensitizing dye is taught.

Hasebe et al U.S. Pat. Nos. 4,820,624 and 4,865,962 disclose producing emulsions containing grains that exhibit corner development by starting with a cubic or tetradecahedral host grain emulsion and adding silver bromide and spectral sensitizing dye or sulfur and gold sensitizing in the presence of an adsorbed organic compound.

Sugimoto and Miyake, "Mechanism of Halide Conversion Process of Colloidal AgCl Microcrystals by $Br^-$ Ions", Parts I and II, *Journal of Colloid and Interface Science,* Vol. 140, No. Dec. 1990, pp. 335–361, report observations of silver bromide deposition selectively onto the edges and corners of host cubic high chloride grains.

Techniques that result in the formation of silver bromide more or less uniformly over the surfaces of silver chloride host grains are disclosed by Houle et al U.S. Pat. No. 5,035,992; Japanese published applications (Kokai) 252649-A (priority 02.03.90-JP 051165 Japan) and 288143-A (priority 04.04.90-JP 089380 Japan).

Related Patent Applications

Maskasky U.S. Ser. No. 762,971, filed Sep. 20, 1991, commonly assigned, titled IMPROVED PROCESS FOR THE PREPARATION OF HIGH CHLORIDE TABULAR GRAIN EMULSIONS (II), now U.S. Pat. No. 5,178,997 (hereinafter designated Maskasky IV) discloses a process for preparing a high chloride tabular grain emulsion in which silver ion is introduced into a gelatino-peptizer dispersing medium containing a stoichiometric excess of chloride ions of less than 0.5 molar and a 2-hydroaminoazine grain growth modifier of the formula:

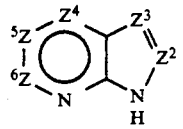

where $Z^2$ is —C($R^2$)= or —N=;

$Z^3$ is —C($R^3$)= or —N=;

$Z^4$ is —C($R^4$)= or —N=;

$Z^5$ is —C($R^5$)= or —N=;

$Z^6$ is —C($R^6$)= or —N=;

with the proviso that no more than one of $Z^4$, $Z^5$ and $Z^6$ is —N=;

$R^2$ is H, $NH_2$ or $CH_3$;

$R^3$, $R^4$ and $R^5$ are independently selected, $R^3$ and $R^5$ being hydrogen, hydrogen, halogen, amino or hydrocarbon and $R^4$ being hydrogen, halogen or hydrocarbon, each hydrocarbon moiety containing from 1 to 7 carbon atoms; and $R^6$ is H or $NH_2$.

Maskasky U.S. Ser. No. 819,712, filed Jan. 13, 1992 (as a continuation-in-art of U.S. Ser. No. 763,382, filed Sep. 20, 1991) and commonly assigned, titled IMPROVED PROCESS FOR THE PREPARATION OF HIGH CHLORIDE TABULAR GRAIN EMULSIONS (IV), now U.S. Pat. No. 5,185,239, (hereinafter designated Maskasky V) discloses a process for preparing a high chloride tabular grain emulsion in which silver ion is introduced into a gelatino-peptizer dispersing medium containing a stoichiometric excess of chloride ions of less than 0.5 molar, a pH of at least 4.6, and a triaminopyrimidine grain growth modifier containing mutually independent 4, 5 and 6 ring position amino substituents with the 4 and 6 ring position substituents being hydroamino substituents. This grain growth modifier is a 2-hydroaminozine species.

Maskasky U.S. Ser. No. 820,168, filed Jan. 12, 1992 (as a continuation-in-art of U.S. Ser. No. 763,382, filed Sep. 20, 1991) and commonly assigned, titled IMPROVED PROCESS FOR THE PREPARATION OF HIGH CHLORIDE TABULAR GRAIN EMULSIONS (V), now U.S. Pat. No. 5,183,732, (hereinafter designated Maskasky VI) discloses a process for preparing a high chloride tabular grain emulsion in which silver ion is introduced into a gelatino-peptizer dispersing medium containing a stoichiometric excess of chloride ions of less than 0.5 molar, a pH of at least 4.6, and a 2-hydroaminoazine grain growth modifier of the formula:

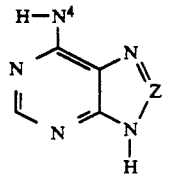

where $N^4$ is an amino moiety and

Z represents the atoms completing a 5 or 6 member ring.

Maskasky and Chang U.S. Ser. No. 763,013, filed Sep. 20, 1991, commonly assigned, titled IMPROVED PROCESS FOR THE PREPARATION OF HIGH CHLORIDE TABULAR GRAIN EMULSIONS (III), now U.S. Pat. No. 5,178,998, (hereinafter designated Maskasky et al I) discloses a process for preparing a high chloride tabular grain emulsion in which silver ion is introduced into a gelatino-peptizer dispersing medium containing a stoichiometric excess of chloride ions of less than 0.5 molar and a grain growth modifier of the formula:

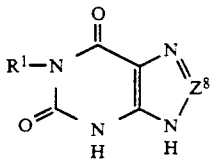

where $Z^8$ is $-C(R^8)=$ or $-N=$;

$R^8$ is H, $NH_2$ or $CH_3$; and $R^1$ is hydrogen or a hydrocarbon containing from 1 to 7 carbon atoms.

The grain growth modifier is not a 2-hydroaminoazine.

Maskasky and Chang U.S. Ser. No. 820,181, filed Jan. 13, 1992, now U.S. Pat. No. 5,176,992, (hereinafter referred to as Maskasky et al II) and commonly assigned, titled PROCESS FOR THE PREPARATION OF A GRAIN STABILIZED HIGH CHLORIDE TABULAR GRAIN PHOTOGRAPHIC EMULSION (II), discloses a process of preparing an emulsion for photographic use comprising (a) forming an emulsion as taught by Maskasky et al I, above, (b) reducing the pH of the dispersing medium below 4.0 to inactivate the xanthinoid as a morphological stabilizer, and (c) replacing the inactivated xanthinoid on the tabular grain surfaces by adsorption of the photographically useful compound, the photographically useful compound being selected from among those containing at least one divalent sulfur atom, thereby concurrently morphologically stabilizing the tabular grains and enhancing their photographic utility.

Maskasky U.S. Ser. No. 820,182, filed Jan. 13, 1992 (as a continuation-in-art of U.S. Ser. No. 763,030, filed Sep. 20, 1991, now U.S. Pat. No. 5,217,858) and commonly assigned, titled PROCESS FOR THE PREPARATION OF A GRAIN STABILIZED HIGH CHLORIDE TABULAR GRAIN EMULSION (I), now U.S. Pat. No. 5,221,602 (hereinafter designated Maskasky VII) discloses a process for preparing a high chloride tabular grain emulsion in which morphologically unstable tabular grains having {111} major faces account for greater than 50 percent of total grain projected area and contain at least 50 mole percent chloride, based on silver. The emulsion additionally contains at least one 2-hydroaminoazine adsorbed to and morphologically stabilizing the tabular grains. Protonation releases 2-hydroaminoazine from the tabular grain surfaces. Released 2-hydroaminoazine is replaced on the tabular grain surfaces by adsorption of a photographically useful compound selected from among those that contain at least one divalent sulfur atom, thereby concurrently morphologically stabilizing the tabular grains and enhancing their photographic utility, and the released 2-hydroaminoazine is removed from the emulsion.

Maskasky U.S. Ser. No. 935,802, filed concurrently herewith and commonly assigned, titled PROCESS FOR THE PREPARATION OF A GRAIN STABILIZED HIGH CHLORIDE TABULAR GRAIN EMULSION (II), (hereinafter designated Maskasky VIII) discloses a process essentially similar to that of Maskasky VII, except that a 5-iodobenzoxazolium compound is substituted for the compound containing a divalent sulfur atom.

Maskasky U.S. Ser. No. 935,806, filed concurrently herewith and commonly assigned, titled PROCESS FOR THE PREPARATION OF A GRAIN STABILIZED HIGH CHLORIDE TABULAR GRAIN EMULSION (III), (hereinafter designated Maskasky IX) discloses a process essentially similar to that of Maskasky VII, except that a cationic or zwitterionic benzimidazolium dye is substituted for the compound containing a divalent sulfur atom.

SUMMARY OF THE INVENTION

In one aspect this invention is directed to a process of preparing an emulsion for photographic use comprising (1) forming an emulsion comprised of silver halide grains and a gelatino-peptizer dispersing medium in which morphologically unstable tabular grains having {111} major faces account for greater than 50 percent of total grain projected area and contain at least 50 mole percent chloride, based on silver, the tabular grains being formed in the presence of at least one 2-hydroaminoazine adsorbed to and morphologically stabilizing the tabular grains, and (2) adsorbing to surfaces of the tabular grains a photographically useful compound:

Wherein (a) the tabular grains are transformed into composite grains consisting of tabular host and epitaxial portions by selectively depositing a silver salt at one or more corners of the tabular grains in the presence of the adsorbed 2-hydroaminoazine, the epitaxial portions accounting for less than 20 mole percent, based on total silver, of the composite grains and chloride ions being present in said epitaxial portions in a concentration ranging up to two thirds the chloride ion concentration in said tabular host portions, (b) the adsorbed 2-hydroaminoazine is protonated and thereby released from the tabular grain surfaces into the dispersing medium, (c) the released 2-hydroaminoazine is replaced on the tabular grain surfaces by adsorption of a photographically useful compound capable of functioning as a morphological stabilizer, and (d) released 2-hydroaminoazine is removed from the dispersing medium.

The present invention offers a combination of advantages. The 2-hydroaminoazine is employed both as a morphological stabilizer for the tabular grains and, in combination with selected precipitation parameters, is used to direct silver salt epitaxy selectively to the corners of the tabular grains. By reason of differing in composition from the host tabular grains the silver salt epitaxy functions to locate latent image forming sites at the corners of the tabular grains. Corner location is the most advantageous position for latent image formation to occur, since it minimizes competition between epitaxial sites for photogenerated electrons. If the epitaxial sites are too close together, this can result in less than optimum photographic sensitivity, since no one site is, at marginal exposure levels, capable of gathering enough photogenerated electrons to produce a developable latent image.

From a review of the various citations above, it is apparent that the majority of emulsion preparations rely on one species or another of 2-hydroaminoazine, typically adenine or a 4,6-(dihydroamino)pyrimidine lacking a 5-position amino substituent, as a grain growth modifier to produce high chloride tabular grains having {111} major grain faces. Despite the efficacy of these grain growth modifiers to produce and maintain the desired tabular grain morphologies, at a minimum they represent an additional emulsion ingredient, thereby adding to the complexity of photographic emulsions that often contain many ingredients and adding to the complexity of photographic elements that can contain many different layers, often including multiple emulsion layers of varying composition and photographic performance characteristics. To the extent that the grain growth modifiers remain adsorbed to the tabular grains they compete with other adsorbed photographic addenda for grain surface sites. To the extent that the grain growth modifiers equilibrate with the surrounding emulsion dispersing medium they can affect other photographic element layers and solutions used for processing.

In the practice of the present invention at least a portion of the adsorbed 2-hydroaminoazine grain growth modifier is released from the high chloride tabular grain surfaces and replaced by one or more photographically useful adsorbed photographic addenda capable of preventing the morphologically unstable tabular grains with {111} major faces from reverting to less photographically desirable morphological grain forms.

A further distinct advantage of the present invention is that released 2-hydroaminoazine grain growth modifier is removed from the emulsion. This can be used to minimize or eliminate entirely subsequent interaction of the grain growth modifier with other portions of the photographic element in which the emulsion is incorporated (e.g., other emulsion layers) as well as eliminating any possibility of accumulating the grain growth modifier in processing solutions (particularly acidic solutions). Still further, the released and removed 2-hydroaminoazine can be reclaimed, thereby minimizing waste and allowing reuse of the grain growth modifier in preparing subsequent emulsions.

BRIEF DESCRIPTION OF THE DRAWINGS

FIGS. 1, 3, 4 and 5 show emulsions prepared according to the process of the invention;

FIGS. 2, 6 and 7 show emulsions prepared by comparative processes;

FIG. 8 shows arrested grain development of an emulsion prepared by a comparative process; and FIG. 9 shows arrested grain development of an emulsion prepared by a process of the invention.

DESCRIPTION OF PREFERRED EMBODIMENTS

Figure 1:
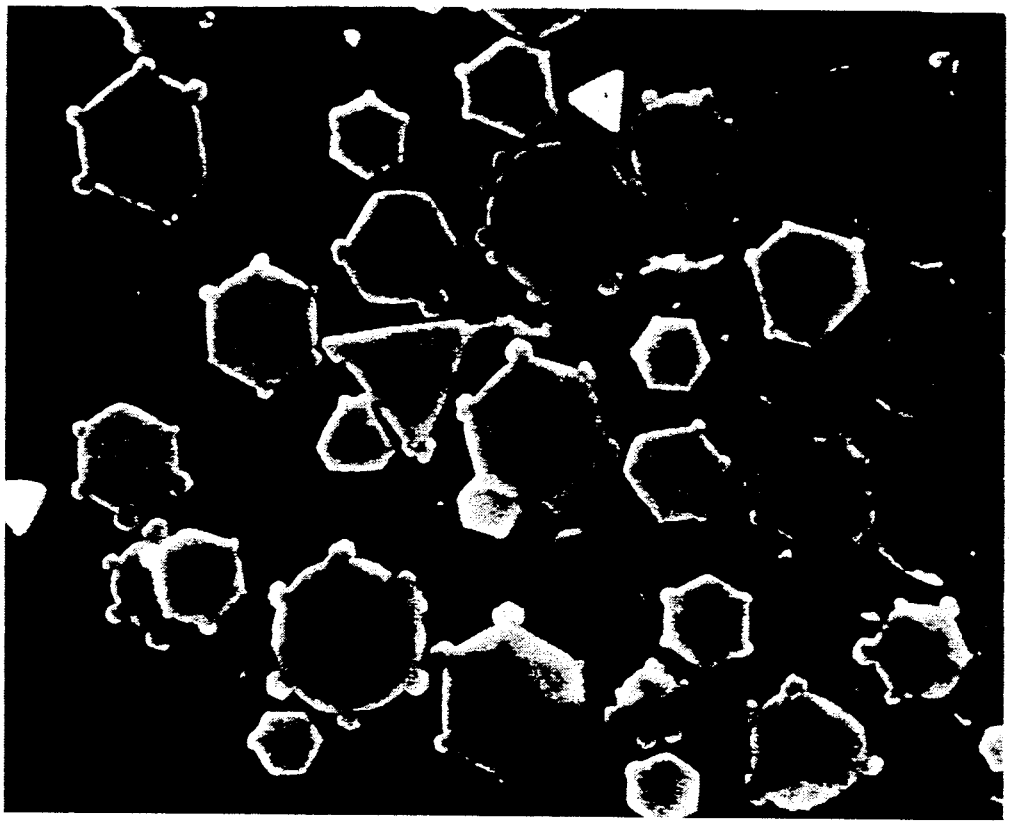
FIGS. 1 to 7 inclusive are scanning electron photomicrographs and FIGS. 8 and 9 are carbon replica electron photomicrographs.

The present invention is directed to a process of improving for photographic use the properties of a high chloride tabular grain emulsion in which the tabular grains have major faces lying in {111} crystallographic planes and rely on a 2-hydroaminoazine adsorbed to surfaces of the tabular grains for morphological stabilization. The formation of high chloride tabular grain emulsions in the presence of a 2-hydroaminoazine are illustrated by Maskasky U.S. Pat. Nos. 4,435,501 and 4,713,323, King et al U.S. Pat. No. 4,942,120, Tufano et al U.S. Pat. No. 4,804,621, Japanese patent application 03/116,133, published May 17, 1991, Houle et al U.S. Pat. No. 5,035,992, and Japanese patent application 89,380, published Dec. 18, 1991, as well as the following allowed patent. applications: Maskasky (IV), Maskasky (V) and Maskasky (VI), the disclosures of which are here incorporated by reference.

After forming a high chloride tabular grain emulsion in the presence of a 2-hydroaminoazine morphological stabilizer and with the 2-hydroaminoazine remaining adsorbed to the tabular grain surfaces, silver salt epitaxy is selectively deposited on the high chloride tabular grains at their corners, where each corner of a tabular grain is considered to be formed by both of its major faces. The spacing between the major faces of the tabular grains is so small that adjacent corners of the major faces and the edge joining the major face corners are all considered to be part of the same tabular grain corner. Note that a single silver salt epitaxy deposit covers an entire corner portion of the grain. A tabular grain with hexagonal major faces has 6 corners, a tabular grain having triangular major faces has 3 corners, and less commonly encountered trapezoidal tabular grains have 4 corners.

Any amount of silver salt epitaxy can be employed that can be selectively deposited at the corners of the tabular grains. Generally higher levels of sensitivity (and reduced risk of forming edge depositions separated from the corners of the tabular grains that can compete for photogenerated electrons) are realized when the silver salt is deposited at a concentration of less than 20 mole percent, based on total silver forming the composite grains (the host tabular grains and the epitaxial deposits). Preferably the concentration of silver salt is maintained less than 10 mole percent (and optimally less than 5 mole percent) based on the total silver forming the composite grains. Only very small amounts of silver salt epitaxy are effective to produce latent image sites selectively at the corners of the tabular grains. Silver salt epitaxial depositions that are too small to be observed by microscopic examination have been found to be effective in locating latent image sites. Maskasky III (U.S. Pat. No. 4,435,501) discloses incremental sensitivity to result from silver salt concentrations as low as 0.05 mole percent, based on total silver present in the composite grains, with silver salt concentrations of at least 0.3 mole percent being preferred.

The silver salt epitaxy can be formed by depositing any of the various silver salts known to form sensitizing epitaxial deposits on silver chloride host grains. Specific examples of such silver salts are contained in Maskasky U.S. Pat. Nos. 4,435,501, 4,463,087 and 4,471,050, the disclosures of which are here incorporated by reference.

The epitaxial deposits contemplated for use in the practice of this invention are those that are capable of locating the latent image sites formed by exposure. If the silver salt deposited at the tabular grain corners and the host tabular grain are of the same composition, the silver salt at the corners of the host tabular grains simply merges with the tabular grain host and provides no advantageous effect. Note that corner deposited silver salts that correspond to the composition of the host tabular grains are not within the art recognized definition of epitaxy, which requires a detectable difference between the deposited salt and the host. Generally some (usually at least about 5 mole percent) silver chloride will be occluded in the silver salt epitaxy as it is deposited, but it is generally contemplated that the silver salt epitaxy must contain no more than two thirds (preferably no more than half and optimally no more than one third) the molar concentration of silver chloride in the host tabular grain to be effective in locating a latent image site during exposure.

It is preferred to form the epitaxial deposits of silver halide. The addition of bromide ion or a combination of bromide ion and a lower proportion of iodide ion during precipitation is capable of producing preferred silver halide epitaxy at the corners of the host tabular grains. The silver ion required for formation of the silver salt epitaxy can be supplied by metathesis of the host tabular grain (i.e., silver ion displacement from the host tabular grain) or silver ion can be run into the emulsion during silver salt epitaxial deposition (e.g., by the addition of $AgNO_3$). One of the important considerations leading to limiting silver salt epitaxy to less than 20 mole percent, based on total silver forming the composite grains, as noted above, is to limit metathesis of the host tabular grains. With excessive metathesis the tabular integrity of the host grains can be diminished or destroyed. Usually the center of the tabular grain is thinned, with continued metathesis producing a hole through the center of the tabular grain, followed finally upon continued metathesis by the original tabular grain separating into fragments.

It is preferred to limit the iodide content of the silver halide epitaxy to less than 20 (optimally less than 10) mole percent. The preferred silver salt epitaxy is then silver chlorobromide, silver iodochlorobromide or (less commonly) silver chloroiodobromide, where the halide of higher concentration is named after the halide of lower concentration. When the host tabular grains consist essentially of silver chloride, the silver salt epitaxy can contain up to two thirds the chloride concentration of the host tabular grains—i.e., up to 67 mole percent chloride. When the host tabular grains consist essentially of just greater than 50 mole percent silver chloride, the silver salt epitaxy can contain up to two thirds the chloride concentration of the host tabular grains—i.e., up to 33 mole percent chloride. Silver bromide can form the balance of the silver halide epitaxy. When silver iodide is incorporated in the epitaxy, preferably less than 20 mole percent and, optimally, less than 10 mole percent of the silver halide epitaxy is accounted for by iodide, based on silver in the epitaxy.

If epitaxial deposition is attempted onto the tabular grains in the absence of the 2-hydroaminoazine, the favored site for epitaxial deposition of the silver salt epitaxy is onto the {111} major faces of the tabular grains. In the absence of the 2-hydroaminoazine, initially random epitaxy occurs over the major faces of the tabular grains followed during continued deposition by the formation of a shell and significant disruption of the grain morphology. The adsorbed 2-hydroaminoazine shifts the order of preference for epitaxial deposition to the corners, edges and {111} major faces in that order.

It has been discovered that under identified conditions epitaxial deposition can be directed selectively (substantially exclusively) to the corners of the 2-hydroaminoazine morphologically stabilized tabular grains. Although surface conversion to establish equilibrium of the surrounding dispersing medium with the host tabular grain surface may occur during epitaxial deposition, as Sugimoto and Miyake, cited above, the sole visibly detectable epitaxy lies exclusively at the corners of the tabular grains. The temperature of deposition and the rate of deposition must be controlled to obtain epitaxial deposition selectively at the corners of the tabular grains and also to limit chloride introduction into the epitaxy from the host tabular grains. Relatively low temperatures of epitaxial deposition are contemplated, preferably less than 45° C. This leaves a convenient working range for epitaxial deposition of down to about 15° C. As previously noted, at 55° C. Maskasky (III), cited above, formed epitaxial deposits that were edge specific, but not confined to the corners of host high chloride tabular grains.

It has been observed that epitaxial deposition exclusively onto the corners of the high chloride grains with adsorbed 2-hydroaminoazine present can be achieved at deposition rates of less than $1\times10^{-16}$ mol/grain-corner-minute. From a knowledge of the moles of silver present in an emulsion and the shape and size of the grains, it is possible to calculate the number of grain corners present. From this knowledge the maximum acceptable deposition rate per grain corner can be established. If the critical rate of silver salt addition is exceeded, epitaxial deposition will first spread to the edges of the tabular grains at locations remote from the corners. With a further increase in the introduction renucleation occurs—that is, an entirely new grain population is formed.

Conversely, by slowing epitaxial deposition so that the silver salt ions in solution approach equilibrium with the salt salt ions in the grains, very selective epitaxial deposition can be achieved. It is possible, for example, to limit epitaxial deposition not only to the corners of the tabular grains, but limit epitaxial deposition to only a portion of the tabular grain grain corners. It is possible to prepare tabular grain emulsions in which there is a distribution of corner epitaxy ranging from epitaxy at each tabular grain corner to epitaxy at only one tabular grain corner. It is possible to obtain emulsions according to the invention in which tabular grains having epitaxy limited to only one or two corners account for the majority of the tabular grain population. By reducing the number of epitaxy sites per grain competition between epitaxy sites for photogenerated electrons is reduced and the capacity for achieving higher photographic speeds is enhanced.

Once epitaxial deposition onto the corners of the tabular grains has been achieved, the next objective of the process of the invention is to displace the adsorbed 2-hydroaminoazine with a compound that will be subsequently photographically useful and that is also capable of morphologically stabilizing (i.e., preserving the tabular form of) the grains. The criterion that has been chosen for judging success in morphological stabilization is that the tabular grains must not increase in thickness by more than 50 percent during chemical sensitization. The reason for choosing chemical sensitization is that this step requires holding the emulsion at an elevated temperature and therefore places a much higher stress on the morphological stability of the tabular grains than is customarily encountered in any other step of emulsion preparation.

It is highly preferred that the photographically useful compound chosen as a morphological stabilizer also be capable of stabilizing the silver salt epitaxy. That is, the morphological stabilizer most preferably is capable of retaining the silver salt epitaxy at its initial corner deposition site.

The composite tabular grain emulsions contain, in addition to the corner epitaxy tabular grains and adsorbed 2-hydroaminoazine, a conventional dispersing medium for the grains. The dispersing medium is invariably an aqueous medium and in the overwhelming majority of applications contains a gelatino-peptizer. In the practice of the invention the pH of the dispersing medium is lowered until the 2-hydroaminoazine adsorbed to the tabular grain surfaces is protonated. This transforms the 2-hydroamino moiety into a cationic moiety having a diminished adsorption capability and also renders the protonated 2-hydroaminoazine soluble in the aqueous dispersing medium.

The 2-hydroaminoazine is then at least partially replaced on the composite tabular grain surface by any one or combination of convenient photographically useful addenda capable of morphologically stabilizing the composite tabular grains. The photographically useful addenda provide the morphological stabilization function performed by the 2-hydroaminoazine prior to its protonation and release while the known photographic utility of the replacement adsorbed compound is also realized. In other words the replacement adsorbed compounds is now performing at least two distinct functions.

After the replacement compound has been adsorbed to the tabular grain surfaces, the released protonated 2-hydroaminoazine can be removed from the dispersing medium using any convenient conventional technique for removing emulsion solutes, such as coagulation washing, ultrafiltration and the like. Illustrative procedures of this type are summarized in Research Disclosure, Vol. 308, December 1989, Item 308119, Section II, the disclosure of which is here incorporated by reference. The 2-hydroaminoazine removed from the emulsion can be reclaimed and reused, if desired. If discarded, the 2-hydroaminoazines can be selected for minimal cost and ecological impact. Adenine (Vitamin B4) is a specific example of a low cost, ecologically benign 2-hydroaminoazine.

Preferred high chloride tabular grain emulsions for use in the practice of the invention contain tabular grains accounting for at least 50 percent of total grain projected area that contain at least 50 mole percent chloride, based on total silver. The tabular grains preferably contain less than 5 mole percent iodide. Bromide can account for the balance of the halide. In other words, the invention is applicable to emulsions in which the high chloride tabular grains are silver chloride, silver iodochloride, silver bromochloride, silver bromoiodochloride and/or silver iodobromochloride tabular grains. The chloride content of the tabular grains is preferably at least 80 mole percent and optimally at least 90 mole percent, based on total silver while the iodide content is preferably less than 2 mole percent and optimally less than 1 mole percent. When more than one halide ion is present in the tabular grains, the halides can be uniformly or nonuniformly distributed.

The photographic advantages of tabular grains are a function of their tabularity. Preferred emulsions in which the tabular grains exhibit a high mean tabularity—that is, they satisfy the mean tabularity relationship:

$$\frac{ECD}{t^2} > 25$$

where

ECD is the mean effective circular diameter of the high chloride tabular grains in μm and t is the mean thickness of the high chloride tabular grains in μm.

In terms of mean aspect ratios the high chloride tabular grains preferably exhibit high aspect ratios—that is, $ECD/t > 8$. When high aspect ratio tabular grains exhibit a thickness of 0.3 μm or less, the grains also exhibit high tabularity. When the thickness of the tabular grains is 0.2 μm or less, high tabularities can be realized at intermediate aspect ratios.

Maximum mean tabularities and mean aspect ratios are a function of the mean ECD of the high chloride tabular grains and their mean thickness. The mean ECD of the high chloride tabular grains can range up to the limits of photographic utility (that is, up to about 10 μm), but are typically 4 μm or less. Tufano et al, cited and incorporated by reference above, discloses high chloride tabular grain emulsions satisfying the requirements of this invention having thicknesses ranging down to 0.062 μm (388 {111} crystal lattice planes). In U.S. Ser. No. 763,030, filed Sep. 20, 1991, now allowed, commonly assigned and here incorporated by reference, ultrathin tabular grain emulsions are disclosed in which high chloride tabular grains have mean thicknesses of less than 360 {111} lattice planes. Using a silver chloride {111} lattice spacing of 1.6 Å as a reference, the following correlation of grain thicknesses in μm applies:

360 lattices planes $<0.06$ μm
300 lattices planes $<0.05$ μm
180 lattices planes $<0.03$ μm
120 lattices planes $<0.02$ μm Ultrathin high chloride tabular grain emulsions in which mean grain thicknesses range down to 120 lattice planes can be prepared.

It is specifically contemplated to apply the practice of the present invention to thin ($t<0.2$ μm) and ultrathin (t<360 {111} lattice planes) tabular grains, since the morphological instability of the tabular grains increases as their mean thickness decreases.

To maximize the advantages of having high chloride tabular grains present in the emulsions it is preferred that the high chloride tabular grains account for greater than 70 percent and, optimally, greater than 90 percent of total grain projected area. With care in preparation or when accompanied by conventional grain separation techniques, the projected area accounted for by high chloride tabular grains can approximate 100 percent of total grain projected area for all practical purposes.

Grains other than the high chloride tabular grains, when present in the emulsion, are generally coprecipitated grains of the same halide composition. It is recognized that for a variety of applications the blending of emulsions is undertaken to achieve specific photographic objectives. When the photographically useful compound intended to replace the released protonated 2-hydroaminoazine can be usefully adsorbed to the grains of all component emulsions, the protonation and subsequent process steps can usefully occur after blending. It is therefore apparent that the grains of the emulsion other than the high chloride tabular grains can take any of a wide variety of forms in halide content, size and crystallographic shape. It is generally advantageous to release the 2-hydroaminoazine from the grain surfaces after precipitation and before washing, thereby avoiding a second washing step for removal of protonated 2-hydroaminoazine. When the photographically useful compound intended to replace the released protonated 2-hydroaminoazine is intended to be adsorbed only to the high chloride grain surfaces, the process of the present invention is, of course, practiced before blending.

The essential structural components of the 2-hydroaminoazine can be visualized from the following formula:

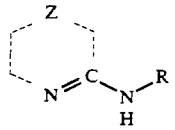

(I)

where

Z represents the atoms completing a 6 member aromatic heterocyclic ring the ring atoms of which are either carbon or nitrogen and R represents hydrogen, any convenient conventional monovalent amino substituent group (e.g., a hydrocarbon or halohydrocarbon group), or a group that forms a five or six membered heterocyclic ring fused with the azine ring completed by Z.

The structural features in formula I that morphologically stabilize the tabular grain {111} crystal faces are (1) the spatial relationship of the two nitrogen atoms shown, (2) the aromatic ring stabilization of the left nitrogen atom, and (3) the hydrogen attached to the right nitrogen atom. It is believed that the two nitrogen atoms interact with the {111} crystal face to facilitate adsorption. The atoms forming R and Z can, but need not, be chosen to actively influence adsorption and morphological stabilization. Various forms of Z and R are illustrated by various species of 2-hydroaminoazines described below.

In one illustrative form the 2-hydroaminoazine can satisfy the formula:

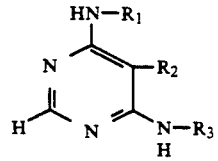

(II)

wherein $R_1$, $R_2$ and $R_3$, which may be the same or different, are H or alkyl of 1 to 5 carbon atoms; $R_2$ and $R_3$ when taken together can be $—CR_4{=}CR_5—$ or $—CR_4{=}N—$, wherein $R_4$ and $R_5$, which may be the same or different are H or alkyl of 1 to 5 carbon atoms, with the proviso that when $R_2$ and $R_3$ taken together form the $—CR_4{=}N—$ linkage, $—CR_4{=}$ must be joined to the ring at the $R_2$ bonding position.

In another illustrative form the 2-hydroaminoazine can satisfy the following formula:

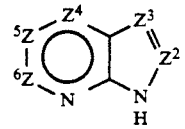

(III)

where $Z^2$ is $—C(R^2){=}$ or $—N{=}$;

$Z^3$ is $—C(R^3){=}$ or $—N{=}$;

$Z^4$ is $—C(R^4){=}$ or $—N{=}$;

$Z^5$ is $—C(R^5){=}$ or $—N{=}$;

$Z^6$ is $—C(R^6){=}$ or $—N{=}$;

with the proviso that no more than one of $Z^4$, $Z^5$ and $Z^6$ is $—N{=}$;

$R^2$ is H, $NH_2$ or $CH_3$;

$R^3$, $R^4$ and $R^5$ are independently selected, $R^3$ and $R^5$ being hydrogen, halogen, amino or hydrocarbon and $R^4$ being hydrogen, halogen or hydrocarbon, each hydrocarbon moiety containing from 1 to 7 carbon atoms; and $R^6$ is H or $NH_2$.

In an additional illustrative form the 2-hydroaminoazine can take the form of a triamino-pyrimidine grain growth modifier containing mutually independent 4, 5 and 6 ring position amino substituents with the 4 and 6 ring position substituents being hydroamino substituents. The 2-hydroaminoazine in this form can satisfy the formula:

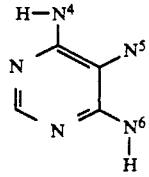

(IV)

where $N^4$, $N^5$ and $N^6$ are independent amino moieties. In a specifically preferred form the 2-hydroaminoazines satisfying formula IV satisfy the following formula:

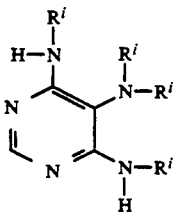

(V)

where $R^1$ is independently in each occurrence hydrogen or alkyl of from 1 to 7 carbon atoms.

In still another illustrative form the 2-hydroaminoazine can satisfy the formula:

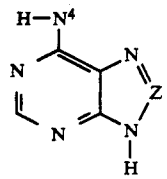

(VI)

where $N^4$ is an amino moiety and

Z represents the atoms completing a 5 or 6 member ring.

The high chloride tabular grain emulsions as initially prepared can contain any concentration of 2-hydroaminoazine capable of morphologically stabilizing the tabular grains. Adequate morphological stabilization of the tabular grains is realized when the 2-hydroaminoazine is present in the emulsion in a concentration of at least 25 percent of monolayer coverage. Maximum protection of the tabular grains is theoretically realized when sufficient 2-hydroaminoazine is present to provide complete (100 percent) monolayer coverage, although in practice maximum attainable morphological stabilization is observed at concentrations of 75 percent of monolayer coverage or less. Inclusions of excess 2-hydroaminoazine beyond that which can be adsorbed to grain surfaces can be accommodated, the excess unadsorbed 2-hydroaminoazine is readily removed by washing.

Protonation of the 2-hydroaminoazine adsorbed to the high chloride tabular grain surfaces to effect release into the dispersing medium can be achieved merely by lowering the pH of emulsion. pH is preferably lowered using the same mineral acids (e.g., sulfuric acid or nitric acid) conventionally used to adjust pH during emulsion precipitation. While each 2-hydroaminoazine is protonated at a slightly different pH, protonation of preferred compounds can be effected within the pH range of from 5.0 to 1.0, most preferably from 4.0 to 1.5. Protonation in these ranges is highly advantageous, since it allows the common pH ranges of emulsion precipitation to be employed and allows protonation to be achieved without subjecting the emulsions to extremely acidic conditions that could degrade other components.

In one preferred form of the invention photographically useful compounds capable of acting as morphological stabilizers can be chosen from among photographically useful compounds containing at least one divalent sulfur atom. Spectral sensitizing dyes, desensitizers, hole trapping dyes, antifoggants, stabilizers and development modifiers are illustrations of different classes of photographically useful compounds that can be selected to contain one or more divalent sulfur atom containing moieties. A wide variety of photographically useful compounds containing one or more divalent sulfur atoms is disclosed in Research Disclosure, Item 308119, cited above and here incorporated by reference.

The following are illustrative of varied divalent sulfur atom moieties commonly found in photographically useful compounds:

$$-S-H \qquad \text{M-1}$$

mercapto $$-S-R^a \qquad \text{M-2}$$

where $R^a$ is any convenient hydrocarbon or substituted hydrocarbon—e.g., when $R^a$ an alkyl group the resulting moiety is an alkylthio moiety (methylthio, ethylthio, propylthio, etc.) and when $R^a$ is an aromatic group the resulting moiety is an arylthio moiety (phenylthio, naphthylthio, etc.) or $R^a$ can be a heterocyclic nucleus, such as any of the various heterocyclic nuclei found in cyanine dyes.

$$-S-S-R^a \qquad \text{M-3}$$

where $R^a$ is as described above

| | |
|---|---|
| M-4 | 1,4-thiazine |
| M-5 | thiazoline |
| M-6 | thiazole |
| M-7 | thiophene |
| M-8 | 3-thia-1,4-diazole |
| M-9 | benzothiazole |
| M-10 | naphtho[2,1-d]thiazole |
| M-11 | naphtho[1,2-d]thiazole |
| M-12 | naphtho[2,3-b]thiazole |
| M-13 | thiazole[4,5-b]quinoline |
| M-14 | 4,5-dihydrobenzothiazole |
| M-15 | 4,5,6,7-tetrahydrobenzothiazole |
| M-16 | 4,5-dihydronaptho[1,2-d]thiazole |
| M-17 | phenanthrothiazole |
| M-18 | acenaphthothiazole |
| M-19 | isorhodanine |
| M-20 | rhodanine |
| M-21 | thiazolidin-2,4-dione |
| M-22 | thiazolidin-2,4-dithione |
| M-23 | 2-dicyanomethylenethiazolidin-4-one |
| M-24 | 2-diphenylamino-1,3-thiazolin-4-one |
| M-25 | benzothiophen-3-one |

The moieties M-1 to M-8 as well as some of the subsequent moieties, such as M-9 and M-20, are commonly encountered in various photographically useful compounds such as antifoggants, stabilizers and development modifiers. The moieties M-5 to M-18 are common heterocyclic nuclei in polymethine dyes, particularly cyanine and merocyanine sensitizing dyes. The moieties M-19 to M-25 are common acidic nuclei in merocyanine dyes. The heterocyclic moieties M-4 to M-25 are named as rings, since the site of ring attachment can be at any ring carbon atom and ring, substituents, if any, can take any convenient conventional form, such as any of the various forms described above in connection with $R^a$.

It is recognized that other chalcogen atoms are capable of providing the same effect as divalent sulfur atoms. There are direct analogues of most photographically useful divalent sulfur atom containing compounds in the form of corresponding divalent selenium atom containing compounds. Further, photographically useful tellurium atom containing compounds are known. A variety of such compounds are disclosed, for example, in Gunther et al U.S. Pat. Nos. 4,581,330, 4,599,410 and 4,607,000, the disclosure of which are here incorporated by reference. Tellurium atoms can replace divalent sulfur and selenium atoms in aromatic heterocyclic nuclei, although the tellurium atoms are generally tetravalent rather than divalent.

Another specifically contemplated class of photographically useful compounds are those containing at least one 5-iodobenzoxazolium nucleus. Such compounds can be selected from among any conventional photographically useful compound containing a 5-iodobenzoxazolium nucleus or can be obtained by introducing by any convenient synthetic technique a 5-iodo substituent into any benzoxazolium compound known to be photographically useful. A wide variety of conventional photographically useful emulsion addenda containing benzoxazolium nuclei are available to choose among. Spectral sensitizing dyes, desensitizers, hole trapping dyes, antifoggants, stabilizers and development modifiers are illustrations of different classes of photographically useful compounds that are known to contain at least one benzoxazolium nucleus and can be selected (or synthetically modified) to contain a 5-iodo substitutent of one or more benzoxazoliun moieties.

For example, Brooker U.S. Pat. No. 2,131,038, the disclosure of which is here incorporated by reference, discloses the utility of benzoxazolium salts as antifogging agents. Tanaka et al U.S. Pat. No. 4,940,657, the disclosure of which is here incorporated by reference, discloses 5-iodo substituted variations of the benzoxazolium salts disclosed by Brooker et al that exhibit both the photographically useful function (antifogging) and morphological stabilization capabilities required for the practice of this invention.

Tanaka et al also discloses spectral sensitizing dyes containing 5-iodobenzoxazolium nuclei. These spectral sensitizing dyes can be used to perform both a spectral sensitization and morphological stabilization function in the practice of this invention.

Further, the 5-iodobenzoxazolium salts employed by Tanaka et al as starting materials for spectral sensitizing dye synthesis can alternatively be employed as starting materials for the synthesis of other spectral sensitizing dyes, hole acceptors and/or desensitizers merely by replacing a conventional benzazolium salt starting material with a corresponding 5-iodobenzoxazolium salt. For example, Gunther et al U.S. Pat. No. 4,576,905, the disclosure of which is here incorporated by reference, discloses the preparation of a wide variety of polymethine dyes by reacting a 2-methylbenzotellurazolium nucleus in a conventional dye synthesis reaction. Dyes useful in the practice of this invention can be prepared merely by substituting any one of the 5-iodo-2-methylbenzoxazolium starting materials of Tanaka et al for any one of the 2-methylbenzotellurazolium starting materials in the syntheses of Gunther et al.

In a simple form the 5-iodobenzoxazolium nucleus can take the following form:

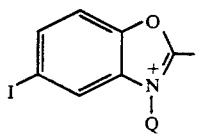

(VII)

where

Q represents a quaternizing substituent.

The quaternizing substituent can take any synthetically convenient form. The quaternizing substituent can take the form of any conventional quaternizing substituent of a basic nucleus of a cyanine dye. Typically the quaternizing substituent is a hydrocarbon or substituted hydrocarbon. The quaternizing substituent preferably contains from 1 to 12 carbon atoms and optimally from 1 to 6 carbon atoms. Examples of hydrocarbon substituents are methyl, ethyl, n-propyl, iso-butyl, iso-pentyl, cyclohexyl, phenyl and phenethyl. Since the dispersing media of silver halide emulsions are hydrophilic, it is often preferred to increase the hydrophilicity of of the benzoxazolium nucleus by providing a substituted hydrocarbon quaternizing substituent that includes a polar or ionizable group. Common solubilizing groups include carboxy, sulfo and sulfato groups. Examples of preferred quaternizing substituents containing such solubilizing groups include carboxyalkyl, sulfoalkyl and sulfatoalkyl groups, where the alkyl groups contain from 1 to 6 carbon atoms in the alkyl moiety (e.g., methyl, ethyl, propyl, butyl, etc.); carboxyaryl, sulfoaryl and sulfatoaryl, where the aryl moiety contains from 6 to 10 carbon atoms (e.g., phenyl, naphthyl, etc.); and similarly substituted aralkyl (e.g., phenylethyl, 2-phenylpropyl, etc.) and alkaryl groups (e.g., tolyl, xylyl, etc.). Other common substituents of hydrocarbon moieties employed as quaternizing groups are halogen (F, Br, Cl or I), aryloxy and alkyoxy groups. Although the quaternizing substituent is shown attached to the benzoxazolium nucleus only at the 3 ring position, it is recognized that the quaternizing substituent can be conveniently attached to the benzoxazolium nucleus at both the 3 and 4 ring positions—i.e., the quaternizing substituent can complete a fused 5 or 6 member ring. For example, Hamer, The Cyanine Dyes and Related Compounds, John Wiley & Sons, 1964, at page 308 discloses a 2-methylbenzoxazolium compound with a 1,3-propanediyl quaternizing substituent bridging the 3 and 4 ring positions, thereby completing a fused 6 member ring.

In formula (VII) above no substituents are shown in the 4, 6 and 7 ring positions. The 7 ring position is preferably free of substitution or limited to a substituent of minimum bulk, such as a fluoro atom. Any synthetically convenient substituent is contemplated for the 4 and 6 ring positions.

The 6 ring position offers a particularly convenient substitution site. In a more general preferred form the 5-iodobenzoxazolium nucleus can take the following form:

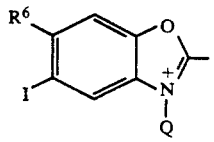

(VIII)

where

Q is a quaternizing substituent, as previously defined;

$R^6$ is hydrogen, halogen or $Q'—(X)_n—$;

Q' is hydrogen or a substituted or unsubstituted hydrocarbon of from 1 to 12, preferably 1 to 6, carbon atoms;

X is a divalent oxygen or sulfur atom; and n is the integer zero or 1. The halogen can be F, Cl, Br or I. Q' can take any of the various forms of substituted or unsubstituted hydrocarbons described above in connection with the quaternizing substituent. When n is 1, the $R^6$ substituent is an oxy or thia substituent—e.g., a hydroxy, alkoxy, aryloxy, mercapto, alkylthia or arylthia substituent.

In the simplest contemplated form of the invention the 5-iodobenzoxazolium nucleus is unsubstituted in the 2 position. That is, in formulae VII and VIII a complete compound consists of formula atoms plus hydrogen attached to the unsatisfied bond at the 2 ring position. A counter ion of any convenient type may also be present if required to provide charge neutrality. For example, if Q and $R^6$ are both charge neutral substituents an anion can be chosen of any suitable type, such as halogen, perchlorate, trifluoromethane-sulfonate, p-toluenesulfonate, tetrafluoroborate, etc. If either Q or $R^6$ is an anionic substituent, the 5-iodobenzoxazolium compound is a charge neutral zwitterionic compound and no counter ion is required. If the 5-iodobenzoxazolium compound contains more than one anionic substituent, a charge balancing cation, such as an alkali metal ion (e.g., $Na^+$, $K^+$ or $Li^+$) or an ammonium counter ion (e.g., triethylamine or pyridinium), completes the 5-iodobenzoxazolium compound.

Thus a simple 5-iodobenzoxazolium compound useful in the practice of the invention can satisfy the formula:

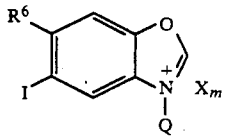

(IX)

where $R^6$ and Q are as previously defined;

X is a charge balancing counter ion; and m is the integer zero or 1.

Since it is synthetically convenient to provide a substituent at the 2 position of the benzoxazolium nucleus, in preferred forms of the invention a more general class of 5-iodobenzoxazolium compounds are contemplated satisfying the formula:

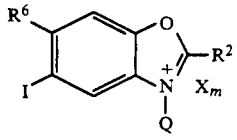

(X)

where $R^6$, Q, X and m can take any form previously described and $R^2$ is hydrogen or any synthetically convenient substituent.

In a simple preferred form $R^2$ is hydrogen or can take any of the various forms described above in connection with $R^6$.

When the photographic utility (in addition to morphological stabilization of the high chloride tabular grains) that the 5-iodobenzoxazolium compound is intended to perform is to function as a photographically useful dye, it is specifically contemplated to choose $R^2$ to complete a dye chromophore.

In still another contemplated form the photographically useful compound can be selected from among dyes containing at least one cationic benzimidazolium nucleus (hereinafter referred to as cationic benzimidazolium dyes. Anionic benzimidazolium dyes have been found to be ineffective as morphological stabilizers. Zwitterionic benzimidazolium dyes have been found to be effective to stabilize host tabular grains, but not effective to stabilizer epitaxial deposits. Only cationic benzimidazolium dyes have been found to be effective to stabilize morphologically both host tabular grains and epitaxial deposits. A variety of photographically useful cationic benzimidazolium dyes are available for selection. In a preferred embodiment the cationic benzimidazolium polymethine dye can take the following form:

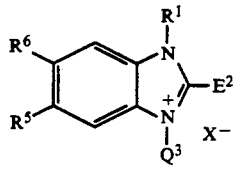

(XI)

where $R^1$ represents hydrogen or alkyl of from 1 to 3 carbon atoms;

$E^2$ represents the atoms completing the polymethine dye;

$R^5$ and $R^6$ independently represent hydrogen or any synthetically convenient substituent;

$Q^3$ represents a quaternizing substituent; and

X represents a charge balancing anion, with the proviso that $R^1$, $R^5$, $R^6$ and $Q^3$ are cationic or nonionic substituents.

The quaternizing $Q^3$ substituent can be selected from among the forms of Q described above. In formula (XI) above no substituents are shown in the 4 and 7 ring positions. The 7 ring position is preferably free of substitution or limited to a substituent of minimum bulk, such as a fluoro atom. Any synthetically convenient substituent is contemplated for the 4 ring position, but in most occurrences benzimidazolium nuclei are unsubstituted in the 4 ring position. The 5 and 6 ring positions offer particularly convenient substitution sites. In specifically preferred forms, $R^5$ and $R^6$ can be selected from among the forms described above in connection with the $R^6$ substituent of the benzoxazolium compound. The same anions X are useful in both the benzoxazolium and benzimidazolium dyes.

In a specifically preferred form of the invention the photographically useful compound is a polymethine dye containing at least one basic nucleus chosen from among chalcogenazolium, 5-iodobenzoxazolium and cationic benzimidazolium nuclei. The remaining structure of the polymethine dyes can take any convenient conventional form. The polymethine dyes contemplated include cyanines, merocyanines, complex cyanines and merocyanines (i.e., tri-, tetra- and polynuclear cyanines and merocyanines), hemioxonols and streptocyanines. Polymethine dyes are well known to be useful as spectral sensitizing dyes, often concurrently functioning as hole trapping dyes, and, for specialized applications, as electron trapping dyes.

In specifically preferred forms of the invention the cyanine dye is a monomethine cyanine, carbocyanine or dicarbocyanine. Although longer chromophore cyanine dyes are specifically contemplated, particularly where sensitization in the near infrared portion of the spectrum is contemplated, photographic applications requiring spectral sensitization within the visible portion of the spectrum account for the overwhelming majority of cyanine dye uses.

Preferred cyanine dyes satisfying the requirements of the invention are those that satisfy the formula:

$$Z-L^1=(L^2-L^3=)_pN_B \quad (V)$$
$$\rightleftharpoons$$
$$Z=L^1-(L^2=L^3-)_pN_B$$

where

Z is a basic nucleus of the type found in cyanine dyes containing a sulfur, selenium or tellurium atom in an azolium ring; a 5-iodobenzoxazolium nucleus; or a benzimidazolium nucleus;

$L^1$, $L^2$ and $L^3$ are methine (—CR=) groups;

R is hydrogen or a hydrocarbon of from 1 to 6 carbon atoms, optimally alkyl of from 1 to 3 carbon atoms;

p is the integer zero, 1 or 2; and $N_B$ is a basic heterocyclic nucleus of the type found in cyanine dyes.

Basic heterocyclic nuclei typically include those derived from quinolinium, pyridinium, isoquinoinium, 3H-indolium, benz[e]indolium, oxazolium, thiazolium, selenazolium, imidazolium, benzoxazolium, benzothiazolium, benzoselenazolium, benzimidazolium, naphthooxazolium, naphthothiazolum, naphthoselenazolium, thiazolinium, dihydronaphthothiazolium, pyrylium and imidazopyrazinium quaternary salts. The basic heterocyclic nuclei can also include benzo- or naphtotellurazoles and oxatellurazoles, such as those described by Gunther et al U.S. Pat. Nos. 4,575,483, 4,576,905 and 4,599,410, the disclosures of which are here incorporated by reference.

In one specifically preferred class of cyanine dyes useful in the practice of the invention both of the basic nuclei are selected from among nuclei that provide morphological stabilization of the composite grains. For example, the dyes satisfy the formula:

$$Z-L^1=(L^2-L^3=)_pZ \quad (XII)$$
$$\rightleftharpoons$$
$$Z=L^1-(L^2=L^3-)_pZ$$

where

Z, L1, L2, L3 and p are as previously described.

In a specifically preferred form of the invention the cyanine dyes are chosen from among those that exhibit J aggregration when adsorbed to the surfaces of the tabular high chloride grains. That is, the dyes exhibit a J band absorption peak attributable to their adsorbed arrangement on the tabular grain surfaces. A discussion of dye aggregation and its photographic effects is provided by James The Theory of the Photographic Process, 4th Ed., Macmillan, New York, 1977, in Chapter 9.

Examples of J aggregating dyes preferred for use in the practice of the invention are those satisfying the formula:

$$Z-CH=(CR-CH=)_qN_B' \quad (XIII)$$
$$\rightleftharpoons$$

-continued $$Z=CH-(CR=CH-)_qN_B'$$

where

Z and R are as previously described;

q is the integer zero or 1; and $N_B'$ is a benzochalcogenazolium or naphthochalcogenazolium nucleus, where the chalcogen atom in the heterocyclic ring is chosen from among divalent oxygen, sulfur, selenium and tellurium atoms. In a specifically preferred form the invention $N_B'$ is a 5-iodobenzoxazolium nucleus of the type described above. Alternatively $N_B'$ is a benzimidazolium nucleus of the type previously described. When $N_B'$ is a benzochalcogenazolium or naphthochalcogenazolium nucleus, R is preferably a hydrocarbon of from 1 to 3 carbon atoms, and, when $N_B'$ is a benzimidazolium nucleus, R is preferably hydrogen.

In another preferred form the morphological stabilizer can be a merocyanine dye. Merocyanine dyes contain a basic nucleus, in this instance the Z nucleus, described above, linked directly or through an even number of methine groups to an acidic nucleus. In a preferred form the merocyanine dyes useful in the practice of the invention satisfy the formula:

$$Z=(L^4-L^5=)_rN_A \quad (XIV)$$
$$\rightleftharpoons$$
$$Z-(L^4=L^5-)_rN_A$$

where

Z is as previously described;

$L^4$ and $L^5$ are methine groups of any of the varied forms described above;

r is the integer zero, 1 or 2; and $N_A$ is an acidic nucleus.

The acidic nucleus can be selected from among those known to be useful in merocyanine dyes.

Typically acidic nuclei satisfy the formula:

$$-CH=(L^5-L^6=)_sD- \quad (XV)$$
$$\rightleftharpoons$$
$$=CH-(L^5=L^6-)_sD$$

wherein

D is a cyano, sulfo or carbonyl group;

D' is a methine substituent of any of the various types previously described or can with D complete a five or six membered heterocyclic ring containing ring atoms chosen from the class consisting of carbon, nitrogen, oxygen, and sulfur;

$L^5$ and $L^6$ are methine groups of any of the various types previously described; and s is the integer zero or 1.

When D and D' are independent groups, $N_A$ can be chosen from among groups such as malononitrile, alkylsulfonylacetonitrile, cyanomethyl benzofuranyl ketone, or cyanomethyl phenyl ketone. In preferred cyclic forms of $N_A$, D and D' together complete a 2-pyrazolin-5-one, pyrazolidene-3,5-dione, imidazoline-5-one, hydantoin, 2 or 4-thiahydantoin, 2-iminooxazoline-4-one, 2-oxazoline-5-one, 2-thiooxazolidine-2,4-dione, isoxazoline-5-one, 2-thiazoline-4-one, thiazolidine-4-one, thiazolidine-2,4-dione, rhodanine, thiazolidine-2,4-dithione, isorhodanine, indane-1,3-dione, thiophene-3-one, thiophene-3-1,1-dioxide, indoline-2-one, indoline-3-one, indazoline-3-one, 2-oxoindazolinium, 3-oxoindazolinium, 5,7-dioxo-6,7-dihydrothiazolo[3,2-a]pyrimidine, cyclohexane-1,3-dione, 3,4-dihydroisoquinoline-4-one, 1,3-dioxane-4,6-dione, barbituric acid, 2-thiobarbituric acid, chroman-2,4-dione, indazoline-2-one or pyrido[1,2-a]pyrimidine-1,3-dione nucleus.

The photographically useful compound is introduced into the dispersing medium in an amount sufficient to provide at least 20 percent of monomolecular coverage on the grain surfaces. It is preferred to introduce the photographically useful compound in a concentration sufficient to provide from 50 to 100 percent of monomolecular coverage. Introducing greater amounts of the photographically useful compound than can be adsorbed on grain surfaces is inefficient, since unadsorbed compound is susceptible to removal from the emulsion during subsequent washing. If higher concentrations of the photographically useful compound are desired to satisfy its photographic utility unrelated to morphological grain stabilization, further addition of the compound can be deferred until after the washing step.

It is generally preferred to dissolve in the dispersing medium of the emulsion the photographically useful compound intended to replace the 2-hydroaminoazine on the grain surfaces before protonation of the latter is undertaken. In this arrangement the compound adsorbs to the grain surfaces as the 2-hydroaminoazine vacates grain surface sites. This entirely precludes any risk of morphological degradation of the tabular grains by reversion to {100} crystal faces.

As an alternative it is specifically contemplated to lower the pH of the dispersing medium immediately before introduction of the morphologically stabilizing compound. This latter approach has the advantage of allowing morphologically stabilizing compounds that have limited solubility in the dispersing medium to be adsorbed to the grains in preference to precipitation within the dispersing medium. Thus, whether introduction of the morphologically stabilizing compound is optimally undertaken before or after the pH is lowered is a function of the particular compound being employed and particularly its solubility and rate of precipitation.

As previously indicated, the photographically useful compound is preferably introduced into the dispersing medium and the pH of the dispersing medium is reduced before emulsion washing, so that the released protonated 2-hydroaminoazine can be removed from the emulsion without undertaking a second washing step. The 2-hydroaminoazine can be released from the grain surfaces before or after chemical sensitization. The addition of a photographically useful compound, such as a spectral sensitizing dye or antifoggant, to an emulsion before chemical sensitization is a common practice and entirely compatible with the practice of this invention.

Apart from the features of the invention that have been specifically described, the emulsions and their preparation can take any convenient conventional form. Research Disclosure, cited above, Item 308119, is here incorporated by reference for its disclosure of conventional emulsion features, and attention is specifically directed to Sections IV, VI and XXI.

EXAMPLES

The invention can be better appreciated by reference to the following specific embodiments.

Host Emulsion A

AgCl Tabular Grain Emulsion Made Using 4,5,6-triaminopyrimidine as the Growth Modifier.

To a reaction vessel containing 10 L of a stirred solution at pH 6.0 and at 40° C. that was 2% in bone gelatin, 1.5 mM in 4,5,6-triaminopyrimidine, 0.040M in NaCl, and 0.20M in sodium acetate were added 4M $AgNO_3$ solution and 4.5M NaCl solution. The $AgNO_3$ solution was added at 6.25 ml/min for 1 min then its flow rate was accelerated to 110 ml/min during a period of 30 min and finally held constant at 110 ml/min until a total of 6.7 moles of $AgNO_3$ had been added. The 4.5M NaCl solution was added at a rate needed to maintain a constant pAg of 7.67. After the precipitation was complete, 133 g of phthalated gelatin was added. The resulting nonwashed high-aspect-ratio AgCl tabular-grain emulsion consisted of a tabular-grain population which made up 85% of the total projected area of the grains. The tabular grain population had a mean equivalent circular diameter of 1.3 μm, a mean thickness of 0.085 μm, and an average aspect ratio of 15.3.

EXAMPLE 1

Figure 2:
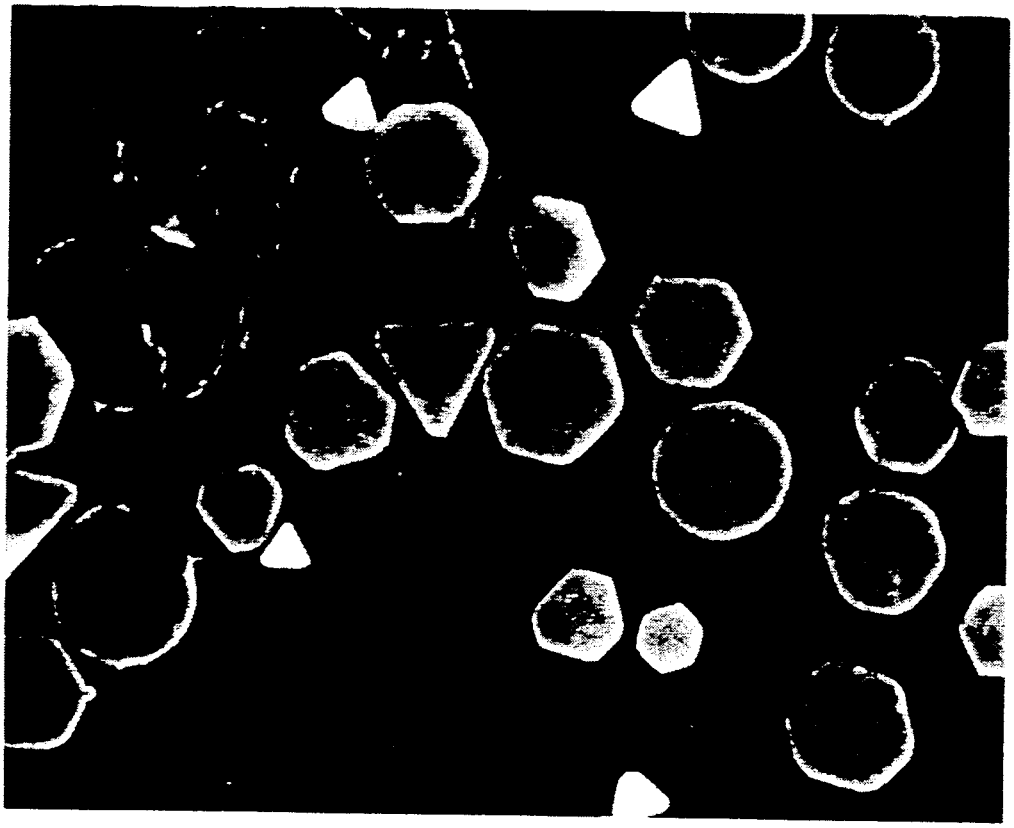
Figure 3:
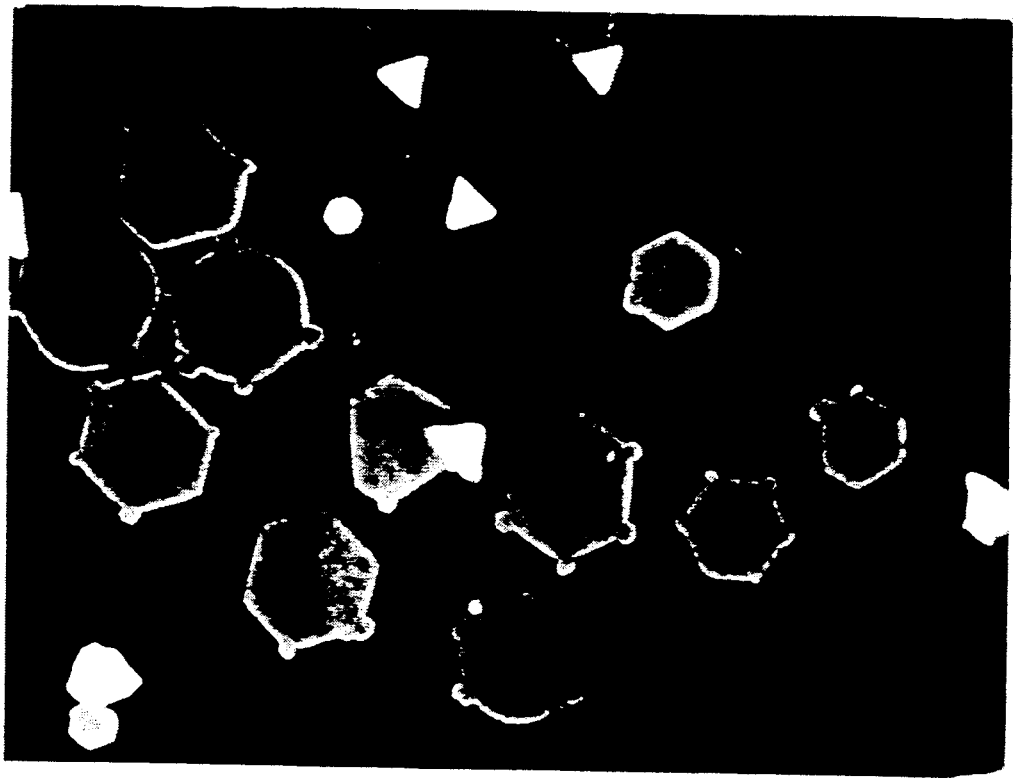
Figure 4:
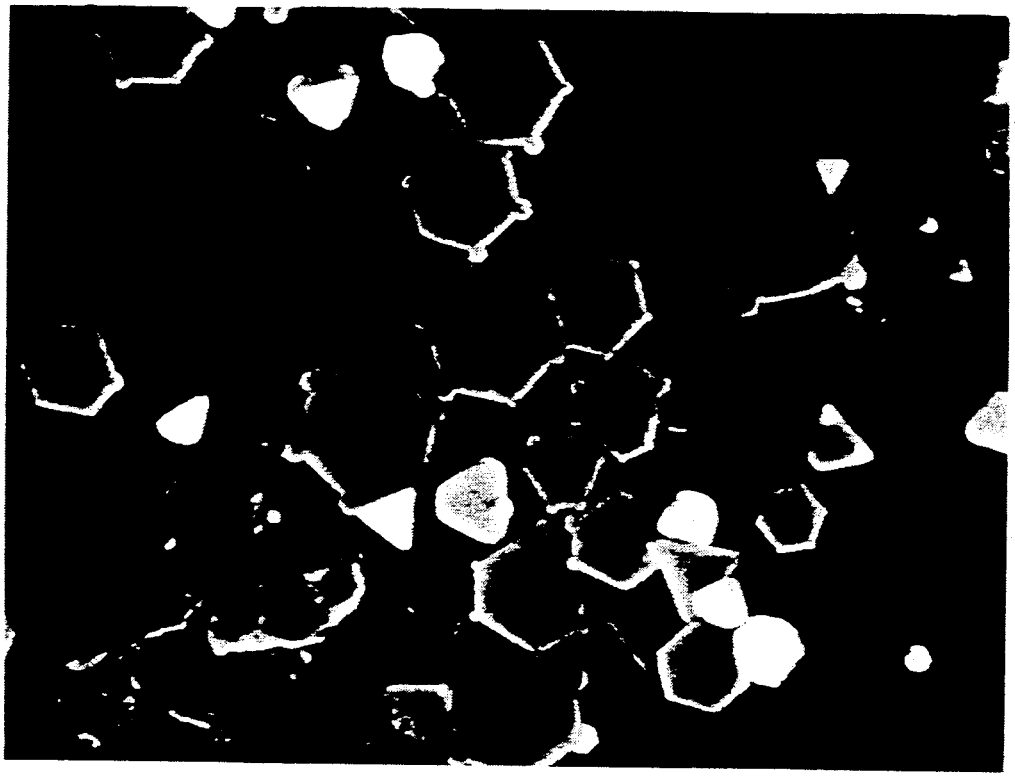
Figure 5:
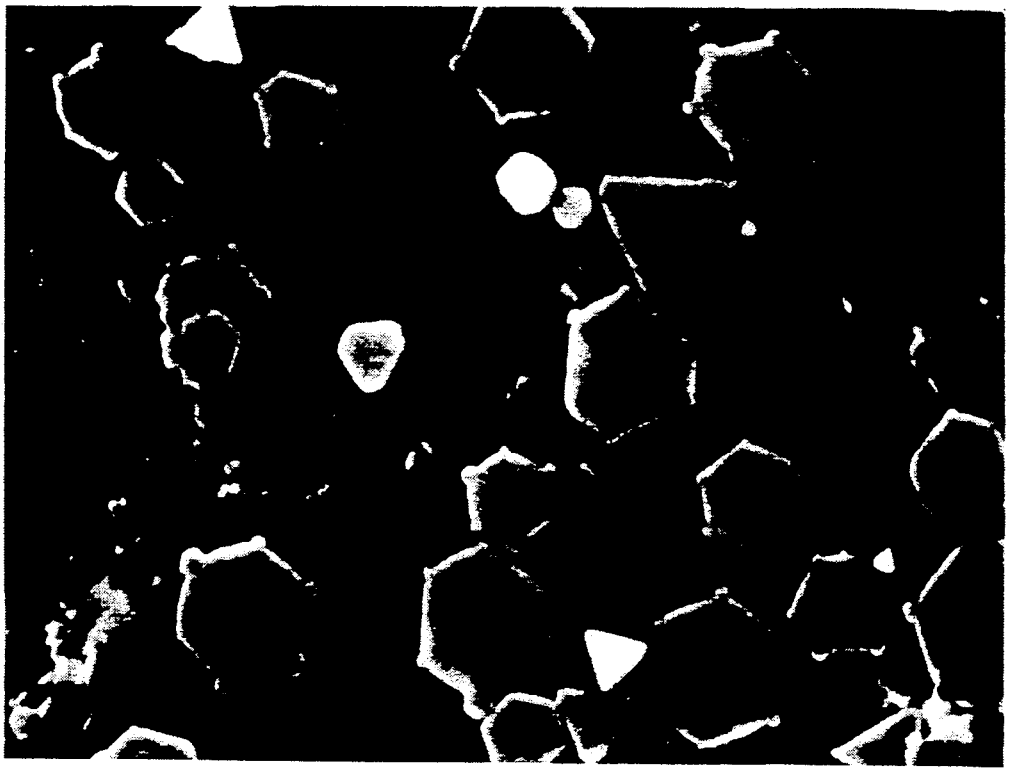
Figure 6:
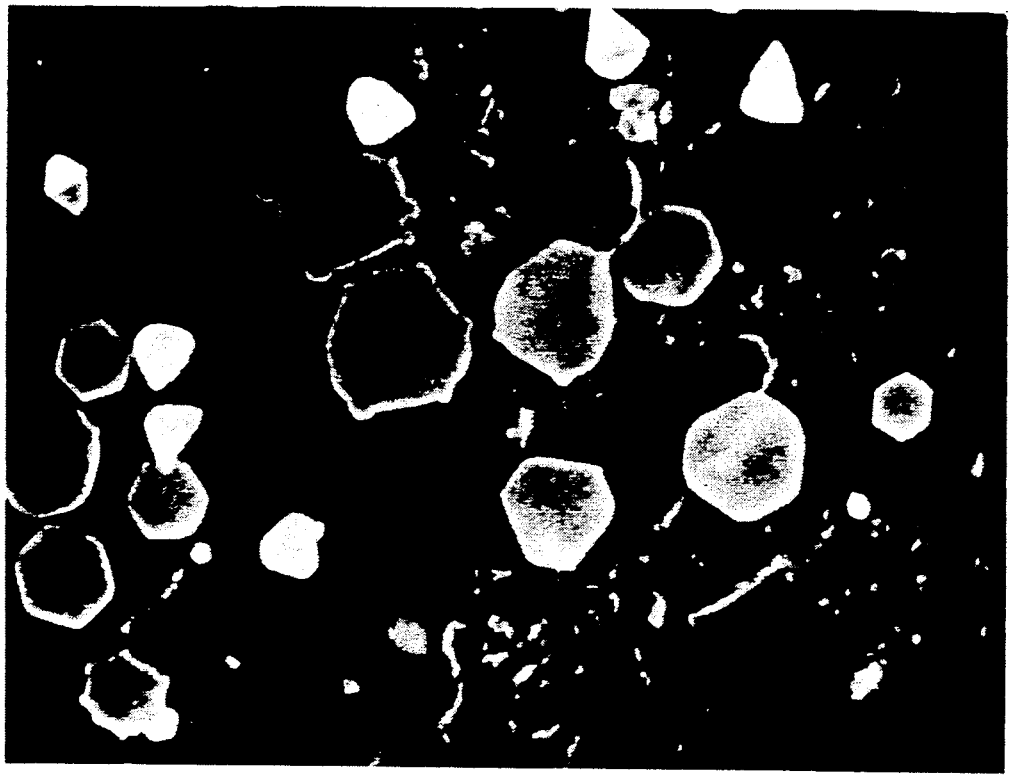

AgBrCl Epitaxy on AgCl Tabular Grain Emulsion; Effect of Bromide Ion Addition Rate To a reaction vessel containing 50 g (0.02 mol) of stirred Host Emulsion A at 25° C. was added 1.0 mmole of a NaBr solution at a concentration and rate which are given in Table 1. The final emulsion was examined by electron microscopy to determine the location of the AgClBr epitaxial growths. Example Emulsion 1b and Control Emulsion 1f are shown in FIGS. 1 and 2, respectively.

TABLE I

| Number | Type | NaBr Sol. Conc. (M) | Flow Rate (ml/min) | Calculated Growth Rate (mol, epitaxy per corner-minute) $\times 10^{17}$ | Mostly Corner Epitaxy |
|---|---|---|---|---|---|
| Ia | Example | 0.2 | 0.5 | 0.35 | Yes |
| Ib | Example | 0.2 | 1.0 | 0.70 | Yes |
| Ic | Example | 0.2 | 2.0 | 1.40 | Yes |
| Id | Example | 0.2 | 5.0 | 3.50 | Yes |
| Ie | Example | 2.0 | 0.5 | 3.50 | Yes |
| If | Control | 2.0 | 5.0 | 35.00 | No |

The Halide Composition of the Epitaxial Phase of Emulsion Made in Example 1b The halide composition of individual grains of Example 1b were analyzed at 100° K. using a Philips CM-12

Analytical Transmission Electron Microscope. X-ray energy-dispersive spectra were collected on five randomly selected grains measuring three epitaxial growths and three regions of each grain. The data are summarized in Table II. The data given are the average composition for the epitaxial growths and the central region of each grain. The data show that the epitaxial growths are composed of predominantly AgBr.

TABLE II

| Grain | Center Region | | Corner Exparity | |
|---|---|---|---|---|
| No. | M % Cl | M % Br | M % Cl | M % Br |
| 1 | 99.6 | 0.4 | 8.6 | 91.4 |
| 2 | 99.5 | 0.5 | 8.6 | 91.4 |
| 3 | 99.9 | 0.1 | 11.4 | 88.6 |
| 4 | 99.7 | 0.3 | 12.0 | 88.0 |
| 5 | 99.7 | 0.3 | 10.0 | 90.0 |
| Average | 99.7 | 0.3 | 10.1 | 89.9 |

EXAMPLE 2

AgClBr Epitaxy on AgCl Tabular Grain Emulsion; Effect of Temperature

To a reaction vessel containing 50 g (0.02 mol) of stirred Host Emulsion A at the temperature given in Table III was added 1.0 mmol of a 0.2M NaBr solution at a rate of 1 ml/min (calculate growth rate of $0.70\times10^{-17}$ mol. epitaxy/corner-min). The final emulsion was examined by electron microscopy to determine the location of the AgClBr epitaxial growth. Example Emulsions 2a, 2c, 2d and 2e are shown in FIGS. 3, 4, 5 and 6, respectively.

TABLE III

| Number | Type | Temperature (°C.) | Mostly Corner Epitaxy |
|---|---|---|---|
| 2a | Example | 20 | Yes |
| 2b | Example | 25 | Yes |
| 2c | Example | 30 | Yes |
| 2d | Example | 40 | Yes |
| 2e | Control | 50 | No |
| 2f | Example | 60 | No |

CONTROL EXAMPLE 3

AgClBr Epitaxy on AgCl Grain Emulsion Without Grain Growth Modifier

This control example shows that the grain growth modifier is necessary to achieve corner directed AgClBr epitaxial growths.

Figure 7:
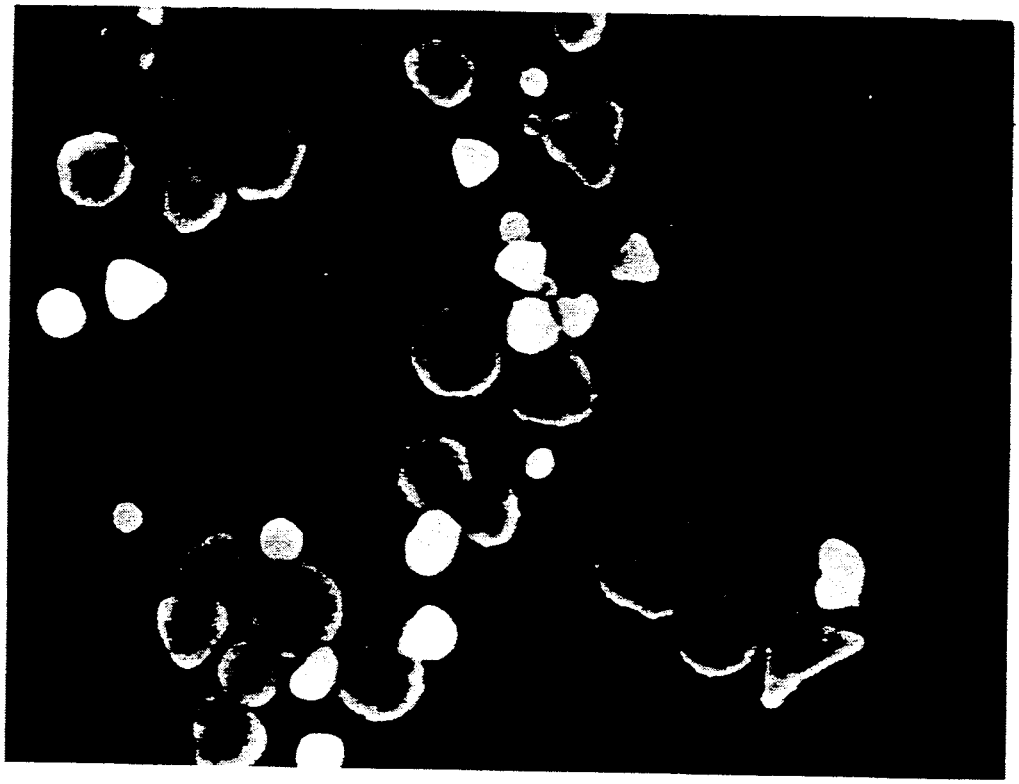

To 50 g Host Emulsion A (0.02 mol) was added 50 g distilled water and then the pH was adjusted to 3.5. The solid phase was resuspended to 50 g with distilled water and adjusted to pH 5.6. This low pH washing was previously shown to remove most of the 4,5,6-triaminopyrimidine grain growth modifier. The resulting emulsion grains had significantly ripened and thickened due to removal of the grain growth modifier. To this emulsion was added at 10° C., 1.0 mmol of a 0.2M NaBr solution at a rate of 0.5 ml/min. The final emulsion consisted of thick and rounded disk-shaped tabular grains having some poorly defined edge growth and considerable surface growth. The relative location of these growths lacked the symmetry that would be expected for "corner" located growths, shown in FIG. 7. The expected symmetry for the relative location of epitaxial growths on a different type of emulsion has been shown for AgBrCl epitaxial growths on AglBr disk-shaped tabular grains. The published picture of a host grain shows six epitaxial deposits symmetrically located about the grain circumference undoubtedly at the unique crystallographic planes that would be found at the host grains' corners; see FIG. 28 of J. Maskasky, J. Imaging Sci. 32,160(1988).

EXAMPLE 4

Photographic Response

Example Emulsion 4a 2 mol % Bromide Epitaxy

To a reaction vessel containing 100 g (0.04 mol) of stirred Host Emulsion A at 25° C. was added 0.8 mmol of a 0.2M NaBr solution at a rate of 1 ml/min (calculated growth rate of $0.35\times10^{-17}$ mol epitaxy/corner-min). Then 1.5 mmol/Ag mol of the spectral sensitizing dye, anhydro-5-chloro-3,3'-di-(3-sulfopropyl)naphtho-[1,2-d]thiazolothiacyanine hydroxide triethylammonium salt, dissolved in methanol was added and after 10 min. 500 ml of distilled water was added. The pH was dropped to 3.5 and the emulsion was allowed to settle for 2 hrs at 2° C. The solid phase was resuspended in a solution that was 1% in gelatin and 4 mM in NaCl to a total weight of 80 g. The pH was adjusted to 5.5 at 40° C. Electron photomicrographs showed that the final emulsion had growths mostly confined to the tabular gains' corners.

Example Emulsion 4b 1.88 mol % Bromide, 0.12 mol % Iodide Epitaxy

Emulsion 4a was repeated except that instead of adding 0.8 mmol of a 0.2M NaBr solution, 0.8 mmol of a solution consisting of 0.188M NaBr and 0.012M NaI was added. Electron photomicrographs showed that the final emulsion had growth mostly confined to the tabular grains corners.

Control Emulsion 4C

No Epitaxy

This emulsion was prepared similarly to that of Example Emulsion 4a except that there was no NaBr solution addition.

Measured Photographic Response

To portions of Example Emulsion 4a, Example Emulsion 4b, and Control Emulsion 4c were added 5 mg/mol of $Na_2S_2O_3.5H_2O$ and 5 mg/mol of $KAuCl_4$ and then they were heated for 5 min at 65° C. to make Example Emulsion 4ax, Example Emulsion 4bx, and Control Emulsion 4cx.

These three sulfur-gold treated emulsions and two nontreated emulsion counterparts, Emulsion 4a and Emulsion 4c, were coated onto polyester film support at 1.22 g Ag/m$^2$ and 3.4 g gelatin/m$^2$. The coatings were exposed for 0.5 sec to a 600 W, 3,000° K tungsten light source through a 0–4.0 density step-tablet The exposed coatings were developed for 5 min in Kodak Developer DK-50 TM at 20° C., The results are given in Table IV. The three example emulsion coatings (4A, 4AX and 4BX) had significantly higher speed than the respective control emulsion coatings (4C and 4CX).

TABLE IV

| Coating | Emulsion | Sulfur-Gold Treated | Fog | Dmax | Relative Speed |
|---|---|---|---|---|---|
| 4C | Control Emulsion 4c | No | 0.07 | 1.01 | 100 |
| 4A | Example Emulsion 4a | No | 0.06 | 1.57 | 2,690 |
| 4CX | Control Emulsion 4cx | Yes | 0.19 | 1.60 | 646 |

TABLE IV-continued

| Coating | Emulsion | Sulfur-Gold Treated | Fog | Dmax | Relative Speed |
|---|---|---|---|---|---|
| 4AX | Example Emulsion 4ax | Yes | 0.14 | 1.54 | 8,710 |
| 4BX | Example Emulsion 4bx | Yes | 0.20 | 1.48 | 7,410 |
| 8 | Control Emulsion 8 | Yes | 0.24 | 1.45 | 2,040 |

Halide Composition of Epitaxy After Chemical Sensitization

The halide composition of the epitaxial phase of the chemically sensitized Example Emulsion 4ax used to prepare Coating 4AX was analyzed using the method described in Example 1. The epitaxial phase was 83.5% (±0.4%) AgBr. (This value is the average of 5 randomly selected grains measuring three growths on each grain.)

Arrested Development

Figure 8:
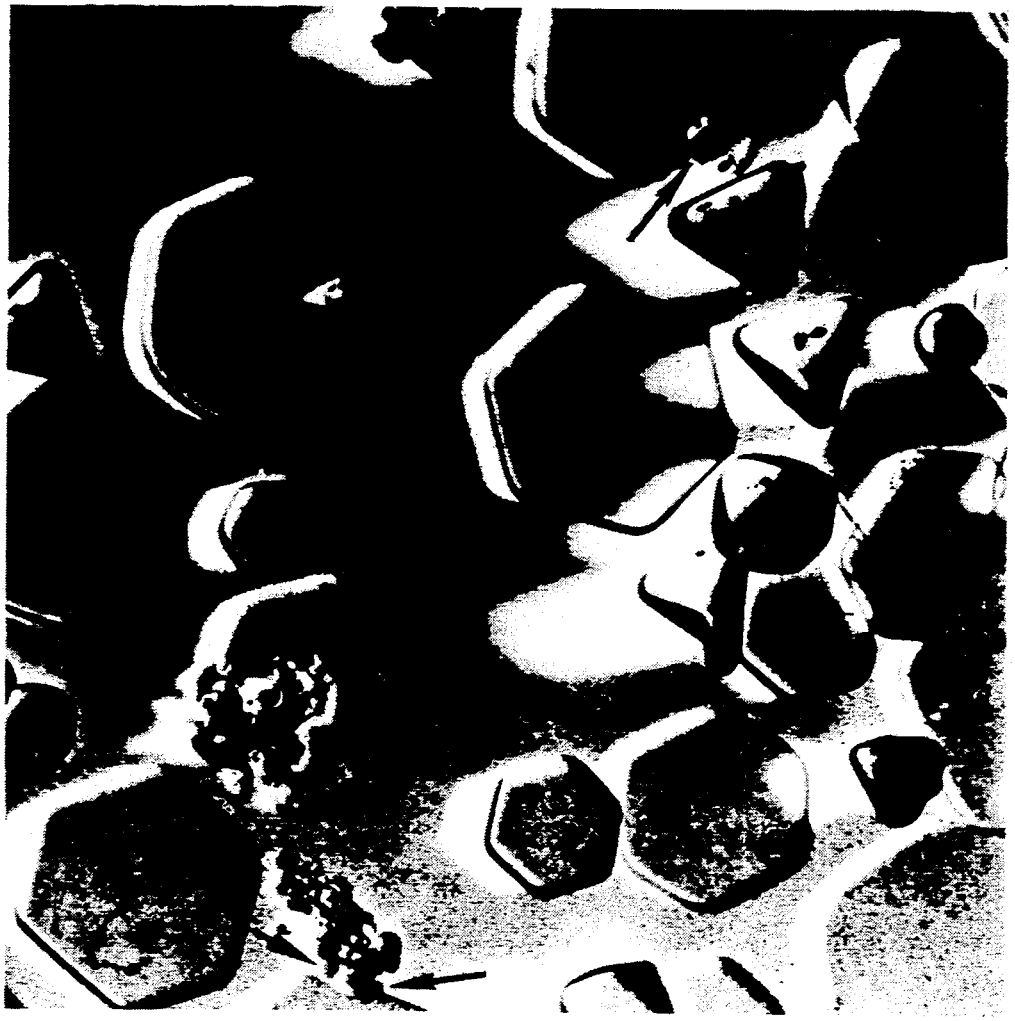
Figure 9:
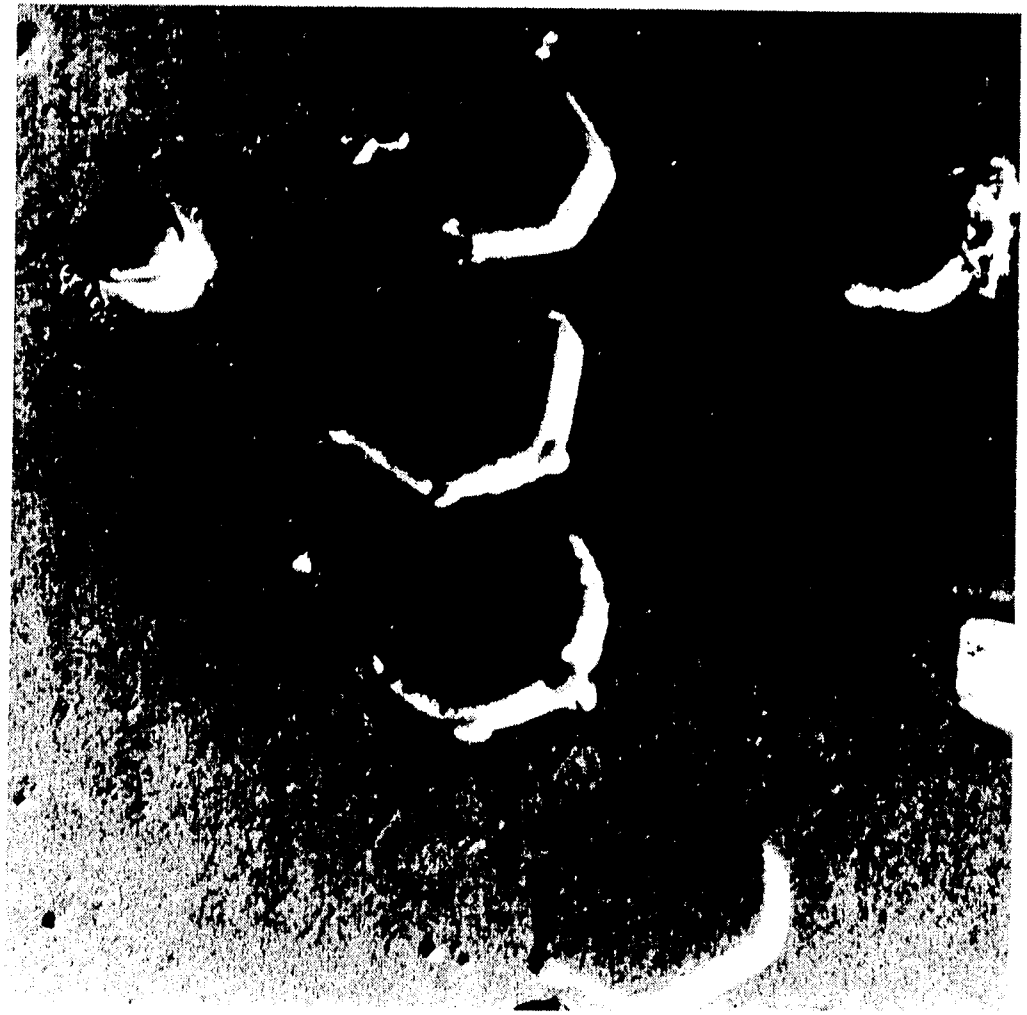

Coatings 4CX and 4AX were each given a 0.5 sec exposure through a neutral density filter. The filter density was selected so that each coating was exposed so that if conventionally processed would just reach Dmax density. This required a higher density filter for Coating 4AX than for Coating 4CX. The coatings were then placed in diluted Kodak Developer DK-50 TM at 20° C. until the coatings showed slight darkening, and were then placed in a 1% acetic acid bath. Electron micrographs of the resulting grains showed that the grains from the control coating, Coating 4CX, formed arrested developed silver randomly on the {111} major faces and along the edges, FIG. 8. While the grains from the example coating, Coating 4AX, formed arrested developed silver mostly confined to the grains' corners, FIG. 9.

EXAMPLE 5

Testing Oxacarbocyanine Dyes and Dyes Containing At Least One Divalent Sulfur Atom for Stabilizing AgCl Tabular Grain Morphology and Stabilizing High Bromide Corner Epitaxy To a reaction vessel containing 100 g (0.04 mol) of stirred Host Emulsion A at 25° C. was added 0.8 mmol of a 0.2M NaBr solution at a rate of 1 ml/min (calculated growth rate of $0.35\times10^{-17}$ mol epitaxy/corner-min). Then 1.5 mmol/Ag mol of the dye stabilizer to be tested dissolved in a solvent was added and the temperature was increased to 40° C. After 5 min at 40° C., 500 ml of distilled water was added. The pH was dropped to 3.5 and the emulsion was allowed to settle for 2 hours at 2° C. The solid phase was resuspended in a solution that was 1% in gelatin and 4 mM in NaCl to a total weight. of 80 g. The pH was adjusted to 5.5 at 40° C. Electron and optical photomicrographs were examined to determine 1) if the tabular grains had retained their high aspect ratio and 2) if tabular grains persisted, are there still observable corner growths.

As shown in Table V, only the oxacarbocyanine dyes having at least one iodo substituent in a number 5 ring position and the dyes containing at least one divalent sulfur atom were found to be stabilizers. Portions of the stabilized Example Emulsions 5c, 5g, 5h, 5i, 5j and 5k, a portion of the partially stabilized Control Emulsion 5f, and a portion of the nonstabilized Control Emulsion 5e were heated for five min at 65° C. to further test their stability. The high aspect ratio tabular grain morphology was preserved for Example Emulsions 5c, 5g, 5h, 5i, 5j and 5k, while Control Emulsions 5e and 5f continued to ripen and lose tabularity.

Stabilizer Test Criteria

The compound of interest was considered to be a AgCl {111} tabular-grain stabilizer if after acid washing the emulsion to remove the growth modifier, the original tabular-grain population did not increase in mean thickness by more than 50%. For these examples that use Host Emulsion A, the mean tabular grain thickness of the acid-washed emulsion must not exceed 0.128 μm for the stabilizer to be considered effective. The compound was considered to be an epitaxial growth stabilizer if electron micrographs showed the presence of one or more corner growths on at least 50% of the tabular grins.

TABLE V

| | | 40° C. | | 65° C. |
|---|---|---|---|---|
| Emulsion | Dye Stabilizer | Tabular Grains Stabilized | Corner Growths Stabilized | Tabular Grains Stabilized |
| Control 5a | anhydro-5,5'-dichloro-9-ethyl-3,3'-di-(3-sulfopropyl)oxacarbocyanine hydroxide, sodium salt | No | No | — |
| Control 5b | anhydro-5,5'-dibromo-9-ethyl-3,3'-di-(3-sulfopropyl)oxacarbocyanine hydroxide, sodium salt | No | No | — |
| Example 5c | anhydro-5,5'-diiodo-9-ethyl-3,3'-di-(3-sulfopropyl)oxacarbocyanine hydroxide, sodium salt | Yes | Yes | Yes |
| Control 5d | anhydro-5,5'-diphenyl-9-ethyl-3,3'-di-(3-sulfopropyl)oxacarbocyanine hydroxide, sodium salt | No | No | — |
| Control 5e | anhydro-5,5'-diphenyl-9-ethyl-3,3'-di-(3-sulfoethyl)oxacarbocyanine hydroxide, pyridinium salt | No | No | — |
| Control 5f | 5,5'-diphenyl-3,3',9-triethyl-oxacarbocyanine bromide | Yes | No | No |
| Example 5g | anhydro-5-iodo-5'-(2-pyrrolecarboxamido)-9-ethyl-3,3'-di(3-sulfopropyloxacarbocyanine hydroxide, sodium salt* | Yes | Yes | Yes |
| Example 5h | 5,5'-diodo-3,3'-dimethyl-thiacarbocyanine trifluoromethanesulfonate | Yes | Yes | Yes |
| Example 5i | 1-carboxymethyl-5-[(3-ethyl-2(3)-a-naphthoxazolyidene)ethylidene]-3-phenyl-2-thiohydantoin | Yes | Yes | Yes |

TABLE V-continued

| Emulsion | Dye Stabilizer | 40° C. Tabular Grains Stabilized | 40° C. Corner Growths Stabilized | 65° C. Tabular Grains Stabilized |
|---|---|---|---|---|
| Example 5j | 3-ethyl-5-{[3-(3-sulfopropyl)benzoxazolinylidenejethyl}rhodanine, sodium salt | Yes | Yes | Yes |
| Example 5k | 3-carboxymethyl-5-{(3-ethyl-2-thiazolidinylidene)ethylidene}rhodanine | Yes | Yes | Yes |
| Control 5l | No dye | No | No | — |

*This dye was added as a partial suspension in dimethylformamide

EXAMPLE 6

Measured Spectrally Sensitized Photographic Response

A control emulsion was prepared which was an AgBr tabular grain emulsion consisting of grains having a mean diameter of 1.7 μm and a mean thickness of 0.085 μm and spectrally sensitized with 1.5 mmol/Ag mol of anhydro-5,5'diiodo-9-ethyl-3,3'-di-(3-sulfopropyl)oxacarbocyanine hydroxide, sodium salt to make Control Emulsion 6a.

To portions of Control Emulsion 6a and Example Emulsion 5c were added 5 mg/mol of $Na_2S_2O_3.5H_2O$ and 5 mg/mol of $KAuCl_4$ and then were heated for 5 min at 65° C. to make Control Emulsion 6ax and Example Emulsion 6cx. Then 1.0 mmol/Ag mol of 1-(3-acetamidophenyl)-5-mercaptotetrazole was added to Example Emulsion 6cx.

Control Emulsions 6a and 6ax and Example Emulsion 6cx were coated onto polyester film support at 2.15 g Ag/m$^2$ and 4.20 g gelatin/m$^2$ and hardened with bis(vinylsulfonyl)methyl ether to make coatings 6A,6AX, and 6CX. The coatings were exposed for 0.5 sec to a 600 W, 3,000° K tungsten light source through a Kodak Wratten WR9 yellow filter and a 0–4.0 density steptablet. The exposed coatings were developed for 1 min in Kodak Developer DK-50 TM at 20° C. The results are given in Table VI. Note that the example coating, Coating 6CX, had a higher minus blue speed than did the control coating, Coating 6AX.

TABLE VI

| Coating | Emulsion | Sulfur-Gold Treated | Absorptance Maxima of Coatings (nm) | Fog | Dmax | Relative Speed |
|---|---|---|---|---|---|---|
| 6A | Control Emulsion 6a | No | 545 | 0.08 | 1.90 | 100 |
| 6AX | Control Emulsion 6ax | Yes | 546 | 0.16 | 2.64 | 720 |
| 6CX | Example Emulsion 6cx | Yes | 544 | 0.16 | 2.68 | 870 |

EXAMPLE 7

Testing Benzimidazolocarbocyanine Dyes for Stabilizing AgCl Tabular Grain Morphology and Stabilizing High Bromide Corner Epitaxy To a reaction vessel containing 100 g (0.04 mol) of stirred Host Emulsion A at 25° C. was added 0.8 mmol of a 0.2M NaBr solution at a rate of 1 ml/min (calculated growth rate of $0.35\times10^{-17}$ mol epitaxy/cornermin). Then 1.5 mmol/Ag mol of the dye stabilizer to be tested dissolved in a solvent was added and the temperature was increased to 40° C. After five min at 40° C., 500 ml of distilled water was added. The pH was dropped to 3.5 and the emulsion was allowed to settle for 2 hours at 2° C. The solid phase was resuspended in a solution that was 1% in gelatin and 4 mM in NaCl to a total weight of 80 g. The pH was adjusted to 5.5 at 40° C. Electron and optical photomicrographs were examined to determine 1) if the tabular grains had retained their high aspect ratio and 2) if tabular grains persisted, are there still observable corner growths.

Portions of these emulsions were additionally heated for five min at 65° C. to further test their ability to stabilize the tabular grain morphology. As shown in Table VII, only the cationic benzimidazolocarbocyanine dyes and the dye, Example 7c, containing at least one divalent sulfur atom were found to be stabilizers.

The suspected stabilizer was tested using the criteria as described in Stabilizer Test Criteria of Example 5.

TABLE VII

| Emulsion | Charge | Dye Stabilizer | 40° C. Tabular Grains Stabilized | 40° C. Corner Growths Stabilized | 65° C. Tabular Grains Stabilized |
|---|---|---|---|---|---|
| Control 7a | anionic | anhydro-5,5',6,6'-tetrachloro-1,1'-diethyl-3,3' di(3-sulfobutyl)benzimidazolocharbocyanine hydroxide | No | No | — |
| Control 7b | zwitterionic | anhydro5,5',6,6'-tetrachloro-1,1',3-triethyl-3-{3[2-sulfatoethyl)oxy]propyl]-benzimidazolocarbocyanine hydroxide | Yes* | No** | No |
| Example 7c | zwitterionic | anhydro-1,1'-diethyl-5,5',6,6'-tetrachloro-3-(3-thiosulfatopropyl-3'-(2,2,2-trifluoroethyl)benzimidazolocarbocyanine hydroxide | Yes | Yes | Yes |
| Example 7d | cationic | 5,5',6,6'-tetrachloro-1,1',3,3'-tetraethylbenzimidazolocarbocyanine trifluoromethanesulfonate | Yes | Yes | Yes |
| Example 7e | cationic | 1,1'-diethyl-3,3'-di(2,2,2-trifluoroethyl)-5,5'6,6'-tetrachlorobenzimidazolocarbocyanine trifluoromethanesulfonate | Yes | Yes | Yes |

TABLE VII-continued

| Emulsion | Charge | Dye Stabilizer | 40° C. Tabular Grains Stabilized | 40° C. Corner Growths Stabilized | 65° C. Tabular Grains Stabilized |
|---|---|---|---|---|---|
| Control 7f | — | no dye | No | No | — |

*The tabular grains were still high aspect ratio (>8) but significant ripening had occurred.
**Epitaxy instability induced by host grain ripening

CONTROL EXAMPLE 8

This example shows that using the transhalogenation process as taught by U.S. Pat. No. 4,786,588 does not result in predominantly AgBr corner epitaxy when applied to predominantly AgCl {111} tabular grain emulsions. Also, the photographic performance obtained was inferior to that of the present invention.

The chemical ripening and transhalogenation process used for Example 7, Emulsion Z4 of U.S. Pat. No. 4,786,588 (a pure AgCl cubic host emulsion) was performed on a portion of Host Emulsion A. Electron micrographs of the resulting emulsion showed that the grains lacked corner epitaxial deposits. The resulting bromide-treated and sulfur-sensitized emulsion was spectrally sensitized, coated, and photographically evaluated similar to those of Example 4. The coated emulsion had a relative speed of 2,040 and a fog density of 0.24. Compared to the chemically sensitized bromide corner epitaxial emulsion, Coating 4AX, Table IV, this emulsion gave significantly lower photographic speed and higher fog density and is therefore considered inferior.

CONTROL EXAMPLE 9

This example shows that using a fine grain AgBr emulsion as the bromide source and ripening it onto AgCl tabular host emulsion grains at 60° C., as described in J03252649A, Example 3, failed to form predominantly AgBr growths at the corners of the AgCl tabular grains. Also, coatings of the resulting emulsion gave inferior photographic performance compared to coatings of a chemically sensitized corner epitaxial tabular-grain emulsion.

An AgCl tabular grain host emulsion, Host Emulsion B, was prepared similar to Host Emulsion A except that the 4.5M NaCl solution was additionally 0.435 mM in $K_4Ru(CN)_6$. The amount of this solution used was 1.56 L and the amount of $K_4Ru(CN)_6$ added during the precipitation was $1.0\times10^{-4}$ mol/Ag mol.

To a portion of Host Emulsion B was added 1 mol % of a fine grain (0.05 μm) AgBr emulsion and the mixture was ripened at 60° C. for 10 min. Electron micrographs of the resulting emulsion showed that epitaxy had formed on less than 1% of the tabular grains' corners. The resulting emulsion was cooled to 40° C. and the pH was adjusted to 7.1 and the pAg to 7.8 with NaCl solution. It was then treated with the chemicals given below in that order and chemically sensitized at 60° C. for 30 min. Per mole of silver was added $1.79\times10^{-2}$ mol NaCl, $5\times10^{-5}$ mol potassium tetrachloroaurate, $2\times10^{-5}$ mol sodium thiosulfate, and $5\times10^{-3}$ mol 4-hydroxy-6-methyl-1,3,3a,7-tetraazaindene.

The sensitized emulsion was coated onto polyester film support at 1.22g Ag/m$^2$ and 3.4 g gelatin/m$^2$ to make Control Coating 9A. This coating and coating 4AX were exposed for 0.5 sec to the 365 nm line of a Hg light source through a 0–4.0 density step tablet. The exposed coatings were developed for 1 min. in Kodak Developer DK-50 TM at 20° C. The results are given in Table VIII. Note that the example coating had lower fog and higher speed than did the control coating.

TABLE VIII

| Coating | $K_4Ru(CN)_6$ Added during host ppt. | Corner Epitaxy | Fog | Dmax | Relative Speed |
|---|---|---|---|---|---|
| Control 9A | Yes | No | 0.30 | 1.20 | 100 |
| Example 4AX | No | Yes | 0.08 | 1.48 | 214 |

The invention has been described in detail with particular reference to preferred embodiments thereof, but it will be understood that variations and modifications can be effected within the spirit and scope of the invention.

What is claimed is:

1. A process of preparing an emulsion for photographic use comprising (1) forming an emulsion comprised of silver halide grains and a gelatino-peptizer dispersing medium in which morphologically unstable tabular grains having {111} major faces account for greater than 50 percent of total grain projected area and contain at least 50 mole percent chloride, based on silver, the tabular grains being formed in the presence of at least one 2-hydroaminoazine adsorbed to and morphologically stabilizing the tabular grains, and (2) adsorbing to surfaces of the tabular grains a photographically useful compound, wherein (a) the tabular grains are transformed into composite grains consisting of tabular host and epitaxial portions by selectively depositing a silver salt at one or more corners of the tabular grains in the presence of the adsorbed 2-hydroaminoazine, the epitaxial portions accounting for less than 20 mole percent, based on total silver, of the composite grains and chloride ions being present in said epitaxial portions in a concentration ranging up to two thirds the chloride ion concentration in said tabular host portions, (b) the adsorbed 2-hydroaminoazine is protonated and thereby released from the tabular grain surfaces into the dispersing medium, (c) the released 2-hydroaminoazine is replaced on the tabular grain surfaces by adsorption of a photographically useful compound capable of functioning as a morphological stabilizer, and (d) released 2-hydroaminoazine is removed from the dispersing medium.

2. A process according to claim 1 in which the tabular grains are chemically sensitized by employing at least one of a gold sensitizer and a middle chalcogen sensitizer prior to releasing the 2-hydroaminoazine from their surfaces.

3. A process according to claim 2 in which at least one of the gold sensitizer and the middle chalcogen sensitizer are added to the emulsion during the step of epitaxial deposition.

4. A process according to claim 2 in which the emulsion is chemically sensitized after the protonated 2-hydroaminoazine is released from grain surfaces.

5. A process according to claim 1 in which the photographically useful compound is present in the emulsion prior to releasing the protonated 2-hydroaminoazine.

6. A process according to claim 1 in which the photographically useful compound contains at least one divalent middle chalcogen atom.

7. A process according to claim 1 in which the photographically useful compound is a 5-iodobenzoxazolium compound.

8. A process according to claim 1 in which the photographically useful compound is a cationic benzimidazolium dye.

9. A process according to claim 1 in which the photographically useful compound is a polymethine spectral sensitizing dye.

10. A process according to claim 9 in which the spectral sensitizing dye is a cyanine or merocyanine dye.

11. A process according to claim 10 in which the spectral sensitizing dye is adsorbed to the tabular grain surfaces in an aggregated form.

12. A process according to claim 1 in which the epitaxial portions account for less than 10 mole percent, based on total silver, of the composite grains.

13. A process according to claim 1 in which the epitaxial portions account for less than 5 mole percent, based on total silver, of the composite grains.

14. A process according to claim 1 in which chloride ions are incorporated in said epitaxial portions in a concentration ranging up to one half the chloride ion concentration in said tabular host portions.

15. A process according to claim 1 in which said epitaxial portions contain a combination of chloride and bromide ions.

16. A process according to claim 1 in which said epitaxial portions contain less than 20 mole percent iodide ions, based on silver.

17. A process according to claim 16 in which said epitaxial portions contain less than 10 mole percent iodide, based on silver.

18. A process according to claim 1 in which the 2-hydroazminoazine is selected from the group consisting of

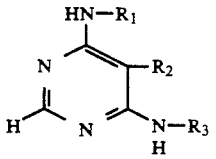

(A)

wherein $R_1$, $R_2$ and $R_3$ are, independently, H or alkyl of 1 to 5 carbon atoms; $R_2$ and $R_3$ when taken together are —$CR_4$=$CR_5$— or —$CR_4$=N—, wherein $R_4$ and $R_5$ are, independently, H or alkyl of 1 to 5 carbon atoms, with the proviso that when $R_2$ and $R_3$ taken together form the —$CR_4$=N— linkage, —$CR_4$= must be joined to the ring at the $R_2$ bonding position;

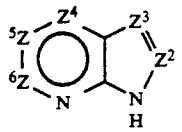

(B)

where $Z^2$ is —C($R^2$)= or —N=;

$Z^3$ is —C($R^3$)= or —N=;

$Z^4$ is —C($R^4$)= or —N=;

$Z^5$ is —C($R^5$)= or —N=;

$Z^6$ is —C($R^6$)= or —N=;

with the proviso that no more than one of $Z^4$, $Z^5$ and $Z^6$ is —N=;

$R^2$ is H, $NH_2$ or $CH_3$;

$R^3$, $R^4$ and $R^5$ are independently selected, $R^3$ and $R^5$ being hydrogen, hydrogen, halogen, amino or hydrocarbon and $R^4$ being hydrogen, halogen or hydrocarbon, each hydrocarbon moiety containing from 1 to 7 carbon atoms; and $R^6$ is H or $NH_2$;

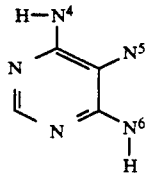

(C)

where $N^4$, $N^5$ and $N^6$ are independent amino moieties; and

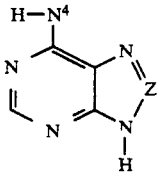

(D)

where $N^4$ is an amino moiety and

Z represents the atoms completing a 5 or 6 member ring.

19. A process according to claim 1 in which the photographically useful compound is chosen from the class consisting of cyanine dyes capable of adsorbing to tabular grain surfaces in an aggregated state and containing at least one sulfur or selenium containing chalcogenazolium, cationic benzimidazolium or 5-iodobenzoxazolium nucleus.

20. A process according to claim 1 in which epitaxial deposition is selectively directed to the corners of the tabular grains by maintaining the emulsion during epitaxial deposition at a temperature of less than 45° C. and by depositing the silver salt at a rate of less than $1\times10^{-16}$ mole per corner-minute.

* * * * *